US005242772A

United States Patent [19]

Kato et al.

[11] Patent Number: 5,242,772

[45] Date of Patent: Sep. 7, 1993

[54] PROCESS FOR THE PRODUCTION OF A LITHOGRAPHIC PRINTING PLATE OF DIRECT IMAGE TYPE

[75] Inventors: Eiichi Kato; Kazuo Ishii, both of Shizuoka, Japan

[73] Assignee: Fuji Photo Film Co., Ltd., Kanagawa, Japan

[21] Appl. No.: 794,891

[22] Filed: Nov. 20, 1991

[30] Foreign Application Priority Data

| | | | |
|---|---|---|---|
| Nov. 20, 1990 | [JP] | Japan | 2-312810 |
| Nov. 30, 1990 | [JP] | Japan | 2-330628 |
| Dec. 18, 1990 | [JP] | Japan | 2-411238 |
| Jan. 31, 1991 | [JP] | Japan | 3-029247 |

[51] Int. Cl.[5] ..... G03G 5/087

[52] U.S. Cl. ..... 430/49; 430/96

[58] Field of Search ..... 430/49, 87, 96

[56] References Cited

U.S. PATENT DOCUMENTS

| | | | |
|---|---|---|---|
| 4,971,870 | 11/1990 | Kato et al. | 430/49 |
| 5,041,348 | 8/1991 | Kato et al. | 430/49 |

*Primary Examiner*—John Goodrow

*Attorney, Agent, or Firm*—Sughrue, Mion, Zinn, Macpeak & Seas

[57] ABSTRACT

According to the present invention, a lithographic printing plate of direct image type capable of preventing the occurrence of background stains and having good printing durability and a process for the production thereof are provided. The process comprises (a) forming an image on a lithographic printing plate precursor comprising a base and a light-insensitive image receptive layer provided on the base, wherein the image receptive layer comprises resin grains comprising at least one polymer component having (1) at least one of a functional group represented by at least one of Formula (I) and Formula (II):

$$-W_1\text{-}(CH_2)_{n1}\text{-}CH{=}CH_2 \qquad \text{Formula (I)}$$

$$-W_2\text{-}(CH_2)_{n2}\text{-}CH_2CH_2\text{-}X \qquad \text{Formula (II)}$$

wherein $-W_1-$ and $-W_2-$ each respectively represents $-SO_2-$, $-CO-$ or $-OOC-$; $n_1$ and $n_2$ each respectively represents 0 or 1; and X represents a halogen atom, or (2) having at least one of a formyl group and a functional group represented by Formula (III):

Formula (III)

wherein $R_1$ and $R_2$, which are the same or different, each represents hydrocarbon groups or $R_1$ and $R_2$ are organic residual radicals which are combined with each other to form a ring and then (b) subjecting a non-image area other than the image area to oil-desensitizing treatment with a solution containing a hydrophilic compound containing a substituent having a Pearson's nucleophilic constant, n, of at least 5.5.

20 Claims, No Drawings

PROCESS FOR THE PRODUCTION OF A LITHOGRAPHIC PRINTING PLATE OF DIRECT IMAGE TYPE

BACKGROUND OF THE INVENTION

1. Field of the Invention

This invention relates to a process for the production of a lithographic printing plate precursor of direct imaging type, suitable for a printing plate precursor for an office work, and to an improved image receptive layer-forming composition for a lithographic printing plate precursor of direct imaging type.

2. Description of the Prior Art

Lately, a lithographic printing plate of direct imaging type, having an image receptive layer on a base, has widely been used as a printing plate precursor for an office work. For carrying out plate making, i.e. imaging on such a printing plate, there have generally been employed a method comprising drawing an image with an oily ink by hand on an image receptive layer, or a method comprising printing it by means of a typewriter, ink jet system or transfer type thermosensible system. Furthermore, there has lately been proposed a method comprising subjecting a light-sensitive material to processings of statically charging, exposing and developing using an ordinary electrophotographic copying machine (plain paper copy machine, PPC), thus forming a toner image on the light-sensitive material and then transferring and fixing the toner image to an image receptive layer. In any case, a printing plate precursor after plate making is subjected to a surface treatment with an oil-desensitizing solution (so-called etching solution) to render a non-image area oil-desensitized and then applied to lithographic printing as a printing plate.

A lithographic printing plate of direct imaging type of the prior art generally comprises a base such as paper, a back layer provided on one side of the base and a surface layer, i.e. image receptive layer provided on the other side of the base through an interlayer. The back layer or interlayer is composed of a water-soluble resin such as PVA and starch, water-dispersible resin such as synthetic resin emulsions and pigment. The image receptive layer as a surface layer is composed of a pigment, water-soluble resin and water proofing agent.

A typical example of the lithographic printing plate precursor of direct imaging type is described in U.S. Pat. No. 2532865 in which the image receptive layer is composed of, as predominant components, a water-soluble resin binder such as PVA, an inorganic pigment such as silica or calcium carbonate and a waterproofing agent such as initial condensate of melamine-formaldehyde resin.

In the thus resulting printing plate of the prior art, however, there arises a problem that when the hydrophobic property is enhanced by increasing the amount of a waterproofing agent or by using a hydrophobic resin so as to improve the printing durability, the printing durability is improved, but the hydrophilic property is deteriorated to cause printing stains, and when the hydrophilic property is improved, the waterproofing property is deteriorated to lower the printing durability. At high temperatures, for example, 30° C. or higher, in particular, the surface layer (image receptive layer) is dissolved in dampening water used for offset printing, thus resulting in lowering of the printing durability and occurrence of printing stains. This is an important disadvantage.

In the lithographic printing plate, moreover, drawing or imaging is carried out using an oily ink as an image area on the image receptive layer, and unless the adhesiveness of this receptive layer and oily ink is good, the oily ink on the image area is separated during printing, thus resulting in lowering of the printing durability, even if the hydrophilic property of the non-image area is sufficient and the printing stains as described above do not occur.

SUMMARY OF THE INVENTION

It is an object of the present invention to provide a lithographic printing plate precursor of direct imaging type, whereby the disadvantages of the prior art, as described above, can be overcome.

It is another object of the present invention to provide a process for the production of a lithographic printing plate of direct imaging type, excellent in oil-desensitivity, whereby not only overall and uniform ground stains but also spot-like ground stains can be prevented when used as an offset master.

It is a further object of the present invention to provide a lithographic printing plate, in which the adhesiveness of an oily ink on an image area to an image receptive layer is improved and during printing, the hydrophilic property of a non-image area is sufficiently maintained even if the number of prints are increased, to thus prevent from occurrence of background stains and show a high printing durability.

These objects can be attained by a process for the production of a lithographic printing plate of direct image type, which comprises forming an image on a lithographic printing plate precursor comprising a base and an image receptive layer provided on the base, the image receptive layer containing at least resin grains containing at least one polymer component having at least one of functional groups represented by the following General Formula (I) and General Formula (II):

$$-W_1\text{-}(CH_2)_{n1}\text{-}CH{=}CH_2 \qquad \text{General Formula (I)}$$

$$-W_2\text{-}(CH_2)_{n2}\text{-}CH_2CH_2\text{-}X \qquad \text{General Formula (II)}$$

wherein $-W_1-$ and $-W_2-$ represent respectively $-SO_2-$, $-CO-$ or $-OOC-$ and $n_1$ and $n_2$ represent respectively 0 or 1 and X represents a halogen atom, or having at least one of formyl group and functional groups represented by the following General Formula (III):

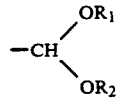

General Formula (III)

wherein $R_1$ and $R_2$ each represent, same or different, hydrocarbon groups or $R_1$ and $R_2$ are organic residual radicals which are combined with each other to form a ring and then subjecting a non-image area other than the image area to oil-desensitizing treatment with a solution containing a hydrophilic compound containing a substituent having a Pearson's nucleophilic constant n of at least 5.5.

DETAILED DESCRIPTION OF THE INVENTION

In a preferred embodiment of the present invention, the resin grains are non-aqueous solvent-dispersed resin grains, as described below.

Non-aqueous solvent-dispersed resin grains:

Copolymer resin grains obtained by subjecting to dispersion polymerization reaction in a non-aqueous solvent, a monofunctional monomer (A) containing at least one of the functional groups represented by the General Formula (I) and General Formula (II) or at least one of formyl group and the functional groups represented by the General Formula (III) and being soluble in the non-aqueous solvent but insoluble after polymerization and a monofunctional polymer (M) comprising a polymer principal chain containing at least recurring units each containing a silicon atom and/or fluorine atom containing substituent, to only one end of which a polymerizable double bond group represented by the following general formula (IV) is bonded:

$$-W_1-(CH_2)_{n1}-CH=CH_2 \qquad \text{General Formula (I)}$$

$$-W_2-(CH_2)_{n2}-CH_2CH_2-X \qquad \text{General Formula (II)}$$

wherein $-W_1-$ and $-W_2-$ represent respectively $-SO_2-$, $-CO-$ or $-OOC-$ and $n_1$ and $n_2$ represent respectively 0 or 1 and X represents a halogen atom,

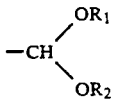

General Formula (III)

wherein $R_1$ and $R_2$ each represent, same or different, hydrocarbon groups or $R_1$ or $R_2$ are organic residual radicals which are combined with each other to form a ring,

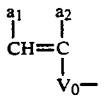

General Formula (IV)

wherein $V_0$ is $-O-$, $-COO-$, $-OCO-$, $-CH_2OCO-$, $-CH_2COO-$,

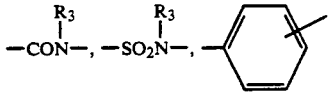

$-CONHCOO-$ or $-CONHCONH-$ ($R_3$ is a hydrogen atom or a hydrocarbon group containing to 18 carbon atoms), and $a_1$ and $a_2$ are, same or different, hydrogen atoms, halogen atoms, cyano groups, hydrocarbon groups, $-COO-R_4$ or $-COO-R_4$ via a hydrocarbon group ($R_4$ is a hydrogen atom or optionally substituted hydrocarbon group).

In the above described resin grains or dispersed resin grains of the present invention, the polymeric component having General Formula (I) and/or General Formula (II), or formyl group and/or General Formula (III) can have a crosslinking structure. In this case, the resin grains have water resisting property which is preferable when the hydrophilic property is realized through reaction with a processing solution for rendering hydrophilic.

The process for the production of a lithographic printing plate precursor of direct image type according to the present invention has the feature that the image receptive layer provided on the support contains resin grains consisting of a resin (which will hereinafter be referred to as Resin (L) containing at least one of functional groups represented by General Formula (I) and General Formula (II) or containing at least one of formyl group and functional groups represented by General formula (III), or contains non-aqueous solvent-dispersed resin grains (which will hereinafter be referred to as resin grains sometimes) consisting of a part insoluble in the non-aqueous solvent, composed of the monofunctional polymer (A') corresponding to the polymeric component containing the functional groups represented by General Formula (I) and/or General Formula (II) or formyl group and/or the functional groups represented by General Formula (III), chemically combined with the monofunctional polymer (M) component being soluble in the solvent.

The dispersed resin grains are non-aqueous latexes, the resin having a molecular weight of $10^4$ to $10^6$, preferably $10^4$ to $10^5$.

In the present invention, the resin grains are present in the image receptive layer as grains independently of the binder resin as a matrix of the image receptive layer. When the resin grains are processed with a processing solution containing at least one of hydrophilic compounds each containing a substituent with nucleophilic reactivity (oil-desensitizing solution or dampening water during printing), the hydrophilic compound containing a substituent with nucleophilic reactivity can additionally be reacted with the end of the functional group of General Formula (I) or General Formula (I) formed by removing the hydrogen halide from the functional group represented by General Formula (II), or with the end of the formyl group and/ or General Formula (III), whereby the photoconductive layer can reveal more hydrophilic property, and when the resin grains have a crosslinked structure, they are not or hardly soluble in water and exhibit water-swelling property while maintaining the hydrophilic property, so good printing property can be maintained without being dissolved out in the dampening water during printing even after printing a number of prints.

In addition, the lithographic printing plate precursor of direct image type of the present invention is not sensitive to environmental influences during plate making, is very excellent in storage property before processing and is capable of undergoing rapidly a processing for rendering hydrophilic.

Such a mechanism that the resin grains contained in the image receptive layer of the present invention are rendered hydrophilic by a hydrophilic compound with nucleophilic reactivity will be illustrated by the following reaction formula (1) in which (p) represents a resin part having the functional group represented by General Formula (I) or (II) and $W_1$ represents an organic residual radical, specifically a linkage moiety $-[Z-Y]-$ in General Formula (V), for example, as to a case of using sulfite ion as the hydrophilic compound of nucleophilic reactivity:

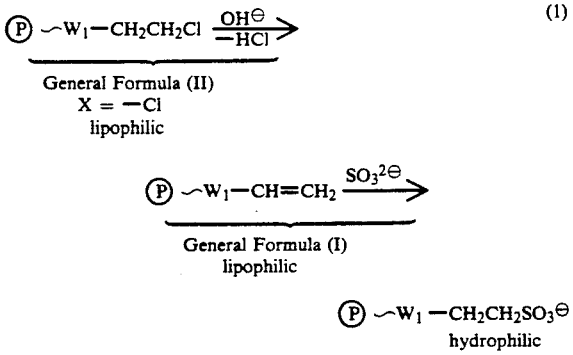

and by the following reaction formula (2), in which P represents a resin part having formyl group and/or the functional group represented by General Formula (III) and $W_1$ has the same meaning as described above:

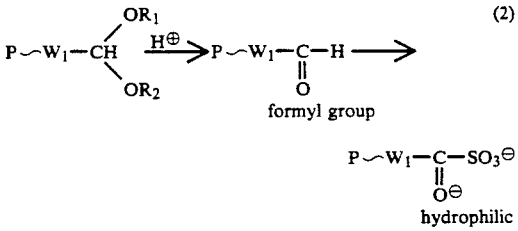

That is to say, the resin grains in the image receptive layer of the present invention have the feature that only when non-image areas as a lithographic printing plate precursor of direct image type is subjected to oil-desensitization, they are reacted with a hydrophilic compound with nucleophilic reactivity, in particular, containing a substituent having a Pearson's nucleophilic constant n of at least 5.5 in a processing solution as described above, whereby the hydrophilic group is added to the end thereof and they are rendered hydrophilic. Since the resin grains are not reactive with moisture in the air, there is no problem to be feared in storage of the lithographic printing plate precursor of the present invention. Since vinylsulfone group, vinylcarbonyl group or acryloxy group, represented by General Formula (I) or formyl group of the present invention is a functional group which is very rapidly reactive with a nucleophilic compound, it is possible to rapidly render hydrophilic.

The functional group represented by General Formula (II) can be converted into the corresponding functional group represented by General Formula (I) by an alkali treatment to readily remove the hydrogen halide as shown in Reaction Formula (1) and can thus be used in the similar manner to General Formula (I). On the other hand, the functional group represented by General Formula (III) can be converted into formyl group by an acid treatment to readily cause the acetal removing reaction as shown in Reaction Formula (2), and can thus be used in the similar manner to the formyl group.

In one feature of the present invention, the resin grains of the present invention contain the polymeric component containing silicon atoms and/or fluorine atoms having remarkably large lipophilic property.

In the printing plate precursor of direct image type, containing the resin grains in the image receptive layer, therefore, when drawing of an image area is carried out with an oily ink, etc. on the image receptive layer, the adhesion of the receptive layer and oily ink is made good to improve the printing durability by the action of the lipophilic groups in the resin grains, while on the other hand, the resin grains rapidly exhibit hydrophilic property to an oil-desensitizing solution or dampening water, as described above, on a non-image area, which can clearly be thus distinguished from the lipophilic property of the image area, and the printing ink does not adhere to the non-image area during printing.

As described above, in the prior art, drawing of an oily ink, etc. is carried out on a hydrophilic resin to render hydrophobic an image area, whilst in the present invention, there is provided a lithographic printing plate precursor of direct image type having advantages resulting from both the hydrophilic property and hydrophobic property of the resin grains, based on the completely different concepts that the resin grains having lipophilic property are subjected to surface treatment to render hydrophilic the non-image area.

In a printing plate precursor of the prior art of such a type that in an image receptive layer, hydrophilic resin grains are dispersed in a binder resin, as a matrix, and a non-image area is processed with an oil-desensitizing solution to render the surface hydrophilic to provide a lithographic printing plate precursor of direct image type, the hydrophilic resin grains are uniformly present throughout the surface layer.

On the contrary, in the present invention, the non-aqueous solvent-dispersed resin grains are dispersed in an image receptive layer, but have the feature that the resin grains are present to be concentrated near the surface area of the image receptive layer, as an air boundary (having high lipophilic property), by the aid of the polymeric component containing fluorine atoms and/or silicon atoms having remarkably large lipophilic property. Thus, the water retention of water of a non-image area can markedly be increased by only dispersing a smaller amount of the resin grains (corresponding to 50 to 10% of the amount of hydrophilic resin grains used in the prior art).

In the present invention, the resin grains contain a hydrophobic polymeric component bonded, which is capable of exhibiting an anchor effect through interaction of the hydrophobic part with the binder resin in the image receptive layer, thus preventing from dissolving out with dampening water during printing and maintaining good printing properties even after a considerable number of prints are obtained.

When a high order network structure is formed in the resin grain of the present invention, moreover, the dissolving-out with water is suppressed and on the other hand, water-swelling property appears to improve the water retention capacity.

That is, in the case of having the network structure, the molecules of the polymeric component (A') forming insoluble parts are crosslinked to form the high order network structure in the above described non-aqueous solvent-insoluble part, whereby the network resin grains are rendered not or hardly soluble in water.

It is important that the resin grains are dispersed in the image receptive layer as grains independently of the binder resin as a matrix and present to be concentrated near the air boundary. Thus, the printing plate precursor of the present invention is capable of providing a printed image of good quality without background stains.

Since the resin grains are fixed by the binder resin, there is no stripping in the various processing steps and a protective action by the binder resin can be obtained. Therefore, the printing precursor of the present invention is characterized by an excellent printing durability, independence on the environment during plate making and excellent storage property before the processings.

Furthermore, it is to be noted that the resin grains are carried away by the hydrophilic property of the specified functional group, i.e. those represented by General Formulas (I), (II) and (III) or formyl group, but this can be solved by crosslinking a part of the resin.

As apparent from the above described illustration, the lithographic printing plate precursor of the present invention has the benefit that an image faithful to an original image can be reproduced without occurrence of background stains because of the good hydrophilic property of a non-image area, the printing durability and the storage property before the processings are very excellent and the precursor is independent on the environment during plate making.

The resin grains used in the present invention will now be illustrated in detail. Specifically, the resin grains of the present invention have a maximum grain diameter of at most 10 μm, preferably at most 5 μm. The average grain diameter thereof is at most 1.0 μm, preferably 0.5 μm. The specific surface area of the hydrophilic resin grains are increased with the decrease of the grain diameter, resulting in good printing property, and the grain size of colloidal grains, i.e. about 0.01 μm or smaller is sufficient. However, very small grains cause the similar troubles to those in the case of molecular dispersion and accordingly, a grain size of 0.05 μm or larger is preferable.

When the resin grains are crosslinked in the present invention, the good printing property can be maintained without dissolving out with the dampening water during printing even after printing a considerable number of prints.

The resin grains of the present invention are preferably used in a proportion of 10 to 90 parts by weight, more preferably 15 to 80 parts by weight, based on 100 parts by weight of the whole weight of the image receptive layer forming composition.

The dispersed resin forming the resin grains of the present invention consists of at least one of Monomers (A) and at least one of Monofunctional Polymers (M) and optionally Multifunctional Monomer (D) hereinafter illustrated in the case of forming a network structure. In any case, it is important that when a resin synthesized from these monomers is insoluble in the non aqueous solvent, the desired dispersed resin can be obtained.

Specifically, it is preferable to use Monofunctional Monomer (M) in a proportion of 1 to 50% by weight, more preferably 5 to 25% by weight to the insolubilized Monomer (A).

In the sum of the recurring units of Monofunctional Polymer (M), the recurring units each having the substituent containing fluorine atoms and/or silicon atoms are preferably present in a proportion of at least 40% by weight, more preferably 60 to 100% by weight to the whole weight of Polymer (M). If the amount of the recurring units is less than 40% by weight, the concentrating effect in the surface area, when the resin grains are dispersed in the surface layer, is lowered, resulting in decrease of the water retention as a printing plater precursor.

The hydrophilic property of the resin grains corresponds to such a hydrophilic property of the film formed by dissolving the resin grains in a suitable solvent and then coating that it has a contact angle with distilled water of 50 degrees or less, preferably 30 degrees or less, measured by an onigometer.

In the case of the network resin grains, the solubility of the resin in water is at most 80% by weight, preferably at most 50% by weight.

The dispersed resin grains (including the network resin grains) of the present invention have preferably an average grain diameter of 0.05 to 1.0 μm. receptive layer is lowered, thus causing decrease of the film strength and toner image strength, while if smaller than 0.05 μm, the similar troubles to those in the case of molecular dispersion take place to deteriorate the effect of the grains to improve the water retention.

Since the dispersed resin grains of the present invention can be synthesized by the dispersion polymerization method in a non-aqueous solvent system, the average grain diameter of high molecular latex grains can be controlled to at most 1 μm with a very narrow distribution of the grain diameters and with a monodisperse system.

If the amount of the dispersed resin grains (including network resin grains) is too small in the present invention, the hydrophilic property of a non-image area is not sufficient and the effect thereof cannot be expected, while if too large, improvement of the hydrophilic property of a non-image area is further made, but the etching speed of the non-image area is lowered and the printing property under severer conditions is deteriorated to degrade a reproduced image. Therefore, the resin grains are generally used in a proportion of 20 to 200% by weight, preferably 80 to 150% by weight, based on 100 parts by weight of the matrix resin of the image receptive layer in the case of containing the functional group represented by General Formula (I) or (II), and 1 to 80% by weight, preferably 5 to 60% by weight, based on 100 parts by weight of the matrix resin of the image receptive layer in the case of containing the functional group represented by General Formula (III) or formyl group.

Resin (L) forming the resin grains according to the present invention will now be illustrated. Resin (L) contains at least the functional group represented by General Formula (I), General Formula (II) and/or General Formula (III) and formyl group The non-aqueous solvent-dispersed resin grains used in the present invention will be illustrated in detail. The resin grains of the present invention can be prepared by the so-called non-aqueous dispersion polymerization. Monofunctional Monomer (A), which is soluble in non-aqueous solvents but is insolubilized by polymerization, contains the functional group represented by General Formula (I) or (II) in the molecular structure, or contains formyl group or the functional group represented by General Formula (III) in the molecular structure. This monomer further contains one polymerizable double bond group.

$$-W_1-(CH_2)_{n1}-CH=CH_2 \qquad \text{General Formula (I)}$$

$$-W_2-(CH_2)_{n2}-CH_2CH_2-X \qquad \text{General Formula (II)}$$

In General Formulae (I) and (II), $-W_1-$ and $-W_2-$ each represent $-SO_2-$, $-CO-$ or $-OOC-$, $n_1$ and $n_2$ each represent 0 or 1 and X represents a halogen atom. In the General Formulae (I) and (II), $n_1$ and $n_2$ are preferably 0 and the halogen atom as X includes fluorine, chlorine, bromine and iodine atoms.

The functional group represented by General Formula (II) can be converted into the corresponding functional group represented by General Formula (I) by an alkali treatment to readily remove the hydrogen halide as shown in Reaction Formula (1) and can thus be used in the similar manner to General Formula (I). On the other hand, the functional group represented by General Formula (II) can be converted into formyl group by an acid treatment to readily cause the acetal removing reaction as shown in Reaction Formula (2), and can thus be used in the similar manner to the formyl group.

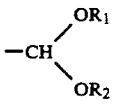

General Formula (III)

wherein $R_1$ and $R_2$ each represent, same or different, hydrocarbon groups or $R_1$ and $R_2$ each represent organic residual radicals which are connected with each other to form a ring.

When $R_1$ and $R_2$ each represent hydrocarbon groups, they are preferably optionally substituted aliphatic groups containing 1 to 12 carbon atoms, for example, optionally substituted alkyl groups containing 1 to 12 carbon atoms, such as methyl, ethyl, propyl, butyl, pentyl, hexyl, octyl, nonyl, decyl, dodecyl, methoxymethyl, ethoxymethyl, 2-hydroxyethyl, 2-chloroethyl, 2-bromoethyl, 1-fluoroethyl, 2-cyanoethyl, 2-methoxyethyl, 2-ethoxyethyl, 3-hydroxypropyl, 3-methoxypropyl groups, etc., optionally substituted alkenyl groups containing 2 to 12 carbon atoms, such as propenyl, butenyl, hexenyl, octenyl docenyl, dodecenyl groups, etc., optionally substituted aralkyl groups containing 7 to 12 carbon atoms, such as benzyl, phenethyl, 3-phenylpropyl, naphthylmethyl, 2-naphthylethyl, methylbenzyl, dimethylbenzyl, trimethylbenzyl, methoxybenzyl, dimethoxybenzyl, chlorobenzyl, bromobenzyl, fluorobenzyl, dichlorobenzyl groups, etc., optionally substituted alicyclic groups containing 3 to 12 carbon atoms, such as cylopentyl, cyclohexyl, cycloheptyl, adamantyl groups, etc. and the like.

When $R_1$and $R_2$ represent organic residual groups which are connected with each other to form a ring, they are preferably functional groups represented by the following general formula (IIIa), that is, cyclic acetal groups:

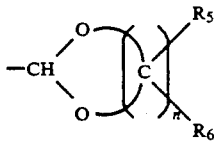

General Formula (IIIa)

wherein $R_5$ and $R_6$ each represent, same or different, hydrogen atoms, optionally substituted hydrocarbon groups containing 1 to 12 carbon atoms or $—OR_7$ groups wherein $R_7$ represents an optionally substituted hydrocarbon group containing 1 to 12 carbon atoms and n represents an integer of 1 to 4.

Preferred examples of the optionally substitute hydrocarbon groups containing 1 to 12 carbon atoms, as $R_5$, $R_6$ and $R_7$, include aliphatic groups having the same contents as those defined in $R_1$ and $R_2$ and aromatic groups such as phenyl, tolyl, xylyl, methoxyphenyl, chlorophenyl, bromophenyl, methoxycarbonylphenyl, dimethoxyphenyl, chloromethylphenyl, naphthyl groups, etc.

In General Formulae (III) and (IIIa), or more preferably, $R_1$, $R_2$ and $R_5$ to $R_7$ are aliphatic groups, for example, alkyl groups of 1 to 6 carbon atoms, alkenyl groups of 3 to 6 carbon atoms and aralkyl groups of 7 to 9 carbon atoms, and n is an integer of 1 to 4.

Specific, but not limiting, examples of the copolymer constituent containing the functional group represented by General Formula (I) and/or General Formula (II) or formyl group and/or the functional group represented by General Formula (III) of Resin [L] include those represented by the following recurring unit of General Formula (V).

On the other hand, the monomer (A) composing the principal component of the resin grains of the present invention can be any one containing at least one of the functional groups represented by General Formulas (I) and (II) or at least one of formyl group and the functional groups represented by General Formula (III) and containing a polymerizable double bond in one molecule. Specific, but not limiting, examples of the monomer (A) include those corresponding to the recurring unit of General Formula (V):

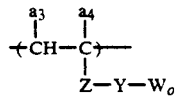

General Formula (V)

wherein Z represents —COO—, —OCO—, —O—, —CO—,

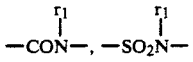

wherein $r_1$ represents hydrogen atom or a hydrocarbon group, —CONHCOO—, —CONHCONH—, —$CH_2$COO—, —$CH_2$OCO— or

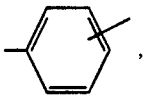

Y represents a direct bond or organic radical for connecting —Z— and —$W_o$, ⟢Z—Y⟣ can directly connect

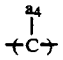

and —$W_o$, $W_o$ represents the functional group represented by General Formula (I) or (II) or formyl group or the functional group represented by General Formula (III) and $a_3$ and $a_4$ may be same or different, each being hydrogen atom, a halogen atom, cyano group, an alkyl group, an aralkyl group or an aryl group.

General Formula (V) will now be illustrated in detail. In this formula Z represents preferably —COO—, —OCO, —O—, —CO—,

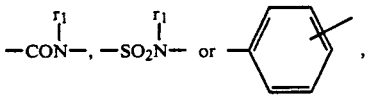

wherein $r_1$ represents hydrogen atom, an optionally substituted alkyl group of 1 to 8 carbon atoms, such as methyl, ethyl, propyl, butyl, pentyl, hexyl, octyl, 2-chloroethyl, 2-bromoethyl, 2-cyanoethyl, 2-methoxyethyl, 2-hydroxyethyl, 3-bromopropyl groups etc., an optionally substituted aralkyl group of 7 to 9 carbon atoms, such as benzyl, phenethyl, 3-phenylpropyl, chlorobenzyl, bromobenzyl, methylbenzyl, methoxybenzyl, chloromethylbenzyl, dibromobenzyl groups, etc., an optionally substituted aryl group such as phenyl, tolyl, xylyl, mesityl, methoxyphenyl, chlorophenyl, bromophenyl, chloromethylphenyl groups, etc.

Y represents a direct bond or an organic radical for connecting —Z— and $—W_o$. When Y represents the organic radical, this radical is a carbon-carbon bond, between which hetero atoms (including oxygen, sulfur and nitrogen atom) may be present, which specific examples include

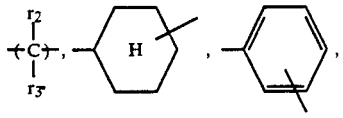

$-\!\!\!

-continued
(a-12)
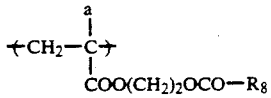
(a-13)
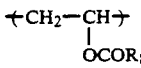
(a-14)
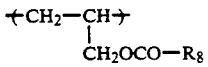
(a-15)
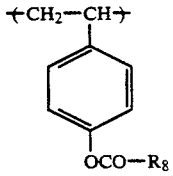
(a-16)
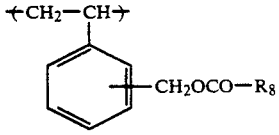
(a-17)
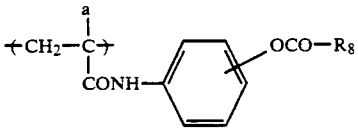
(a-18)
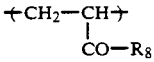
(a-19)
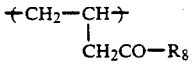
(a-20)
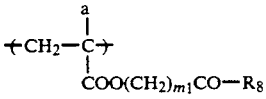
($m_1$: integer of 1~4)
(a-21)
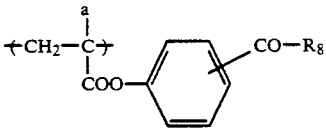
(a-22)
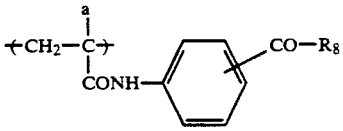
(a-23)
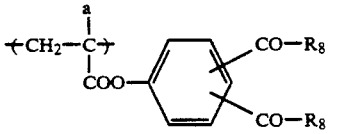
(a-24)
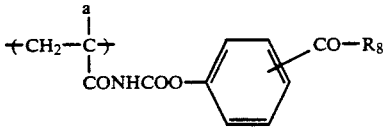
-continued
(a-25)
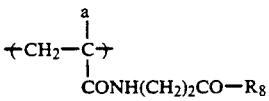
Specific, but not limiting examples of the polymeric constituent containing for formyl group will be illustrated below. In Examples (a-26) to (a-40), a represents —H or —$CH_3$.
(a-26)
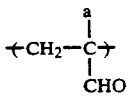
(a-27)
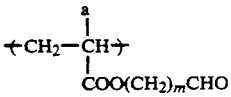
m: integer of 1~6
(a-28)
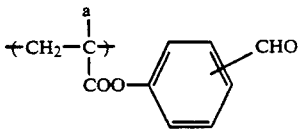
(a-29)
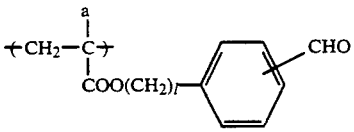
l: integer of 1~4
(a-30)
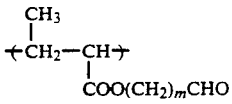
(a-31)
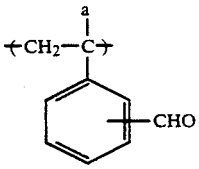
(a-32)
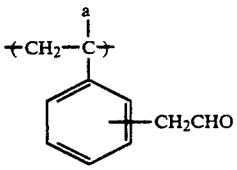
(a-33)
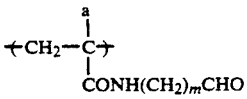
m: integer of 1~6
(a-34)
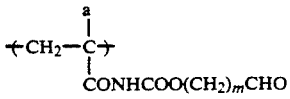

-continued (a-35)

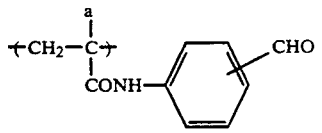

(a-36)

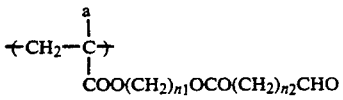

$n_1$: integer of 1~4
$n_2$: integer of 1~3

(a-37)

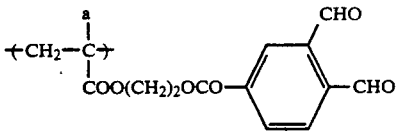

(a-38)

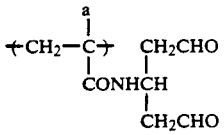

(a-39)

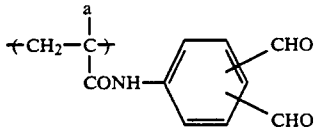

(a-40)

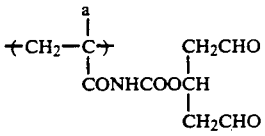

Specific, but not limiting examples of the functional group represented by General Formula (IIIa) of the present invention will be illustrated below. In Examples (a'-1) to (a'-9), $R_9$ and $R_{10}$ each represent alkyl groups of 1 to 4 carbon atoms or $-CH_2C_6H_5$, and $R_{11}$ represents an alkyl group of $C_1$ to $C_4$, $-CH_2C_6H_5$ or phenyl group.

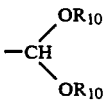

(a'-1)

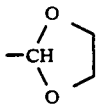

(a'-2)

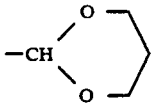

(a'-3)

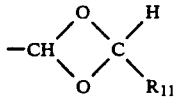

(a'-4)

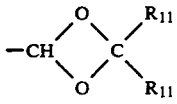

(a'-5)

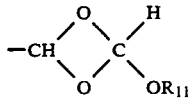

(a'-6)

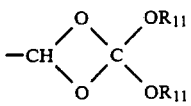

(a'-7)

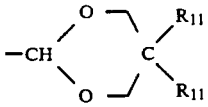

(a'-8)

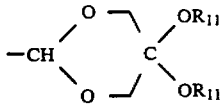

(a'-9)

In Resin (L) of the present invention, the polymeric component containing the functional group represented by General Formula (I) and/or General Formula (II) or containing formyl group and/or the functional group represented by General Formula (III) is generally present in a proportion of 1 to 95% by weight, preferably 50 to 95% by weight based on the whole copolymer in a case where Resin (L) is of the copolymer. Preferably, this resin has a molecular weight of $10^3$ to $10^6$, particularly $5\times10^3$ to $5\times10^5$.

The resin containing the polymeric component containing the functional group represented by General Formula (I) or (II), or containing formyl group or the functional group represented by General Formula (III) as described above can be synthesized by any of known methods, for example, by a method comprising subjecting to polymerization reaction a monomer containing the functional group represented by General Formula (I) or (II), or containing formyl group or the functional group represented by General Formula (III) and a polymerizable double bond group in the molecule (e.g. monomer corresponding to the recurring unit of General Formula (V)) and a method comprising reacting a low molecular compound containing the functional group represented by General Formula (I) or (II), or containing formyl group or the functional group represented by General Formula (III) with a high molecular compound containing a polymeric constituent containing a functional group reactive with the low molecular compound, which is called "polymer reaction".

Moreover, the resin containing the functional group represented by General Formula (I) or formyl group can be synthesized by synthesizing the resin containing the functional group represented by General Formula (II) or (III) and then subjecting respectively to an alkali treatment to remove the corresponding hydrogen halide, or to an acid decomposition treatment. In the above described synthesis by the monomer synthesis or polymer reaction, the formyl- or acetal-formation reaction can readily be carried out in known manner.

Synthesis of formyl group-containing compounds is described, for example, in Nippon Kagakukai Edition, Shin-Jikken Kagaku Koza, Vol. 14, 636 (1978), published by Maruzen KK, E. Müller "Methoden der Organischen Chemie", page 13 (1954), published by Georg Thieme Verlag, Nippon Kagakukai Edition, Jikken Kagaku Koza, Vol. 19, page 231 (1957), published by Maruzen KK, and Yoshio Iwakura and Keisuke Kurita "Reactive Polymers (Hannosei Kobunshi)" page 220 (1977).

Synthesis of acetal group-containing compounds is described, for example, in Nippon Kagakukai Edition, Shin-Jikken Kagaku Koza, Vol. 14, page 611 (1978), published by Maruzen K. K.

The polymerizable function group in the above described monomer synthesis includes ordinary polymerizable double bound groups, for example,

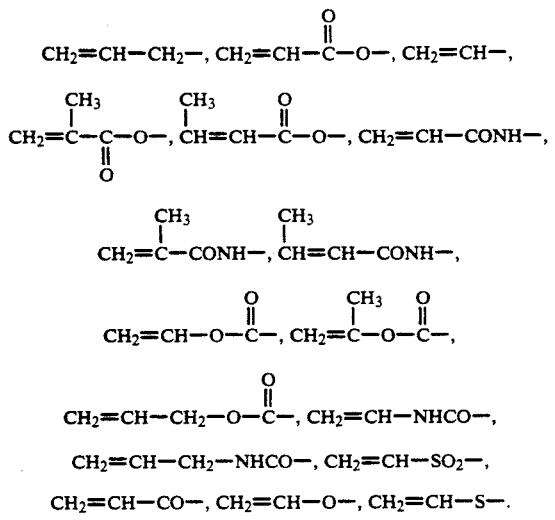

In the above described monomer synthesis or polymer reaction, sulfonylation, carbonylation or arboxylic acid esterification can be carried out by methods, for example, described in Nippon Kagakukai, Shin-Jikken Kagaku Koza, Vol. 14, "Yuki Kagobutsu no Gosei to Hanno (Synthesis and Reaction of Organic Compounds)" page 751, 1000 and 1759 (1978), published by Maruzen KK and S. Patai, Z. Rappoport and C. Stirling "The Chemistry of Sulfones and Sulphoxides" pag 165 (1988), published by John Wiley & Sons.

When Resin (L) is of a copolymer, examples of the monomer copolymerizable with the monomer containing the functional group represented by the above described General formula (I) and/or (II) or formyl group and/or the functional group represented by General Formula (III) are α-olefins, alkanic acid vinyl or allyl esters, acrylonitrile, methacrylonitrile, vinyl ethers, acrylamides, methacrylamides, styrenes, alicyclic vinyls such as vinylpyrrolidone, vinylpyridine, vinylimidazole, vinylthiophene, vinylpyridineimidazoline, vinylpyrazole, vinyldioxane, vinylquinoline, vinylthiazole, vinyl oxazine and the like.

In the present invention, at least a part of the resin grains may be crosslinked. Such a resin that at least a part of the polymer is previously crosslinked (resin having a crosslinked structure in the polymer) is preferably a resin which is hardly soluble or insoluble in acidic or alkaline solutions when the above described functional group contained in the resin gives hydrophilic property through an oil-desensitization treatment. Specifically, the solubility of the resin in distilled water at 20° to 25° C. is preferably at most 90% by weight, more preferably at most 70% by weight.

Introduction of a crosslinked structure in a polymer can be carried out by known methods, that is, (1) a method comprising subjecting a monomer containing the functional group of General Formula (I) and/or (II) or containing formyl group and/or the functional group represented by General Formula (III) to polymerization reaction in the presence of a multifunctional monomer (monomer containing two or more polymerizable functional groups) or a multifunctional oligomer and effecting crosslinking among molecules, (2) a method comprising incorporating functional groups for proceeding the crosslinking reaction in the polymer and crosslinking the polymer containing both the functional groups with a crosslinking agent or hardening agent and (3) a method comprising subjecting a crosslinking functional group-containing polymer to polymer reaction with a compound containing the group of General Formula (I) or (II) or containing formyl group and/or the functional group represented by General Formula (III).

The method (3) by the polymer reaction comprises polymerizing specifically the multifunctional monomer or multifunctional oligomer with a monomer containing a polar group such as —OH, —Cl, —Br, —I, —$NH_2$, —COOH, —SH,

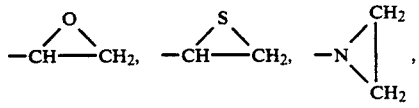

—N=C=O, —COCl, —$SO_2Cl$, etc., into which the functional group of General Formula (I) or (II) or formyl group or the functional group represented by General Formula (III) can be introduced, to prepare a copolymer and then introducing thereinto a low molecular compound containing the functional group of General Formula (I) or (II) or containing formyl group or the functional group represented by General Formula (III) by polymer reaction.

Any of monomers containing two or more same or different ones of these polymerizable functional groups can be used as the multifunctional monomer or oligomer in the above-described method (1).

Of these monomers, as the monomer having two or more same polymerizable functional groups, there can be used styrene derivatives such as divinyl benzene and trivinyl benzene; esters of polyhydric alcohols such as ethylene glycol, diethylene glycol, triethylene glycol, polethylene glycols Nos. 200, 400 and 600, 1,3-butylene glycol, neopentyl glycol, dipropylene glycol, polypropylene glycol, trimethylolpropane, trimethylolethane, pentaerythritol and the like or polyhydroxyphenols such as hydroquinone, resorcinol, catechol and derivatives thereof with methacrylic acid, acrylic acid or crotonic acid, vinyl ethers and allyl ethers; vinyl esters of dibasic acids such as malonic acid, succinic acid, glutaric acid, adipic acid, pimelic acid, maleic acid, phthalic acid, itaconic acid and the like, allyl esrters, vinylamides and allylamides; and condensates of plyamines such as ethylenediamine, 1,3-propylenediamine, 1,4-butylenediamine and the like with carboxylic acids containing vinyl groups such as methacrylic acid, acrylic acid, crotonic acid, allylacetic acid and the like.

As the multifuncational monomer or oligomer having different polymerizable function groups, there can be used, for example, ester derivatives or amide derivaties containing vinyl groups or carboxylic acids containing vinyl group, such as methacrylic acid, acrylic acid, methacryloylacetic acid, acryloylacetic acid, methacryloylpropionic acid, acryloylpropionic acid, itaconyloylacetic acid and itaconyloylpropionic acid, reaction products of carboxylic anhydrides with alcohols or amines such as allyloxycarbonylpropionic acid, allyloxycarbonylacetic acid, 2-allyloxycarbonylbenzoic acid, allylaminocarbonylpropionic acid and the like, for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, 2-(vinyloxycarbonyl)ethyl ester of acrylic acid, N-allylacrylamide, N-allylmethacrylamide, N-allylitaconamide, methcaryloylpropionic acid allylamide and the like; and condensates of amino alcohols such as aminoethanol, 1-aminopropanol, 1-aminobutanol, 1-aminohexanol, 2-aminobutanol and the like with carboxylic acids containing vinyl groups.

The monomer or oligomer containing two or more polymerizable functional groups of the present invention is generally used in a proportion of at most 10 mole%, preferably at most 5 mole% to all monomers, which is polymerized to form a resin.

In the case of a polymer containing the functional group represented by General Formula (I) or formyl group, however, it is preferable not to use $CH_2{=}CH{-}COO{-}$, $$CH_2{=}\overset{\overset{\displaystyle CH_3}{|}}{C}{-}COO{-},$$

$CH_2{=}CH{-}CONH{-}$, $CH_2{=}CH{-}SO_2{-}$ and $CH_2{=}CH{-}CO{-}$ as the foregoing polymerizable functional group.

As the functional group for effecting the crosslinking reaction by the above described method (2) or (3) according to the present invention, there can be used ordinary polymerizable double bond groups (e.g., above-described as a polymerizable double bond group). The crosslinking of polymers by reacting reactive groups among the polymers and forming chemical bonds according to the latter can be carried out in the similar manner to the ordinary reactions of organic low molecular compounds, for example, as disclosed in Yoshio Iwakura and Keisuke Kurita "Reactive Polymers (Hannosei Kobunshi)" published by Kohdansha (1977) and Ryohei Oda "High Molecular Fine Chemical (Kobunshi Fine Chemical)" published by Kohdansha (1976). The polymer reaction by combination of functional groups classified as Group A (functional group having dissociative hydrogen atom) and functional groups classified a Group B in the following Table 1 have well been known. In addition, as the reactive group, there can be used $-CONHCH_2OR_{12}$ wherein $R_{12}$ represents a hydrogen atoms or an alkyl group of 1 to 6 carbon atoms such as methyl, ethyl, propyl, butyl or hexyl group, which has been known as a group for linking by a self-condensation type reaction.

TABLE 1

| Group A | Group B |
|---|---|
| $-COOH$, $-PO_3H_2$ | 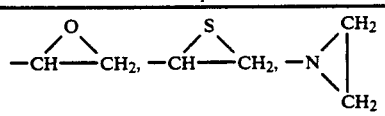 |
| $-OH$, $-SH$, $-NH_2$, $-SO_2H$ | $-COCl_2$, $-SO_2Cl$, cyclic acid anhydride, $-N{=}C{=}O$, $-N{=}C{=}S$, |
| | 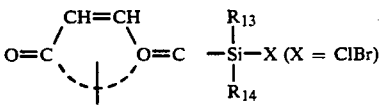 |

In Table 1, $R_{13}$ and $R_{14}$ have the same meaning as the foregoing $r_5$ and $r_6$.

Furthermore, there can be used functional groups and compounds described in, for example, Takeshi Endo "Rendering Precise Heat Setting Polymers (netsu-kokasei Kobunshi no Seimitsuka)" published by C.M.C. KK, 1986, Yuji Harazaki "Latest Binder Technique Handbood (saishin Binder Gijutsu Binran)" Section II-1, published by Sogogijutsu Center, 1985, Takayuki Otsu "Synthesis and "Design of Acrylic Resins and Development of New Uses (Akuriru Jushi no Gosei.Sekkei to Shin-yoto Kaihatsu)" published by Chubu Keiei Kaihatsu Center Shuppanbu, 1985, Eizo Omori "Functional Acrylic Resins (Kinosei Akurirukei Jushi)" published by Technosystem, 1985, Hideo Inui and Gentaro Nagamatsu "Light-sensitive Polymers (Kankosei Kobunshi)" published by Kodansha, 1977, Takahiro Tsunoda "New Light-sensitive Resins (Shin Kankosei Jushi)", published by Insatsu Gakkai Shuppanbu, 1981, G. E. Green and B. P. Star "R. J. Macro. Sci. Reas. Macro. Chem.", C 21 (2), 187-273 (1981-82) and C. G. Roffey "Photopolymerization of Surface Coatings" published by A. Wiley Interscience Publ., 1982.

These crosslinking functional groups can be incorporated in one copolymeric constituent with the functional groups represented by General Formula (I) or (II), or with formyl group or the functional group represented by General Formula (III), or can be incorporated in another copolymeric constituent than a copolymeric constituent containing the functional groups represented by General Formula (I) or (II), or containing formyl group or the group represented by General Formula (III).

Examples of the monomer corresponding to the copolymer constituent containing these crosslinking functional groups include vinyl compounds containing the functional groups copolymerizable with the polymeric constituents of General Formula (V).

These vinyl compounds include those describe in, for example, Kobunshi Gakkai "Polymer Data Handbook -Kisohen-", published by Baihukan, 1986, for example, acrylic acid, αand/or β-substituted acrylic acid such as α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy and α,β-dichloro substituted ones, methacrylic acid, itaconic acid, itaconic acid semi-esters, itaconic acid semiamides, crotonic acid, 2-alkenylcarboxylic acids such as 2-pentenoic acid, 2-methyl 2-hexenoic acid, 2-octenoic acid, 4-methyl-2-hexenoic acid and 4-ethyl-2-octenoic acid, maleic acid, maleic acid semi-esters, maleic acid semiamides, vinylbenzenecarboxylic acid, vinylbenzenesulfonic acid, vinylsulfonic acid, vinylphosphonic acid, semi-ester derivatives of vinyl groups or allyl groups of dicarboxylic acids and ester derivatives and amide derivatives of these carboxylic acids or sulfonic acids containing crosslinking functional groups in the substituents.

To Resin (L) of the present invention can optionally be added a reaction promoter so as to promote the crosslinking reaction, for example, acids such as acetic acid, propionic acid, butyric acid, benzenesulfonic acid, p-toluenesulfonic acid, etc., peroxides, azobis compounds, crosslinking agents, sensitizers, photopolymerizable monomers and the like.

As the crosslinking agent in the present invention, there can be used compounds commonly used as crosslinking agents, for example, described in Shinzo Yamashita and Tosuke Kaneko "Handbook of Crosslinking Agents (Kakyozai Handbook)" published by Taiseisha (1981) and Kobunshi Gakkai Edition "High Molecular Data Handbook -Basis- (Kobunshi Data Handbook -Kisohen-)" published by Baihunkan (1986).

Examples of the crosslinking agent are organosilane compounds such as vinyltrimethoxysilane, vinyltributoxysilane, γ-glycidoxypropyltrimethoxysilane, γ-mercaptopropyltriethoxysilane, γ-aminopropyltriethoxysilane and other silane coupling agents; polyisocyanate compounds such as tolylene diisocyanate, o-tolylene diisocyanate, diphenylmethane diisocyanate, triphenylmethane diisocyanate, triphenylmethane triisocyanate, polymethylenepolyphenyl isocyanate, hexamethylene diisocyanate, isophorone diisocyanate, high molecular polyisocyanates; polyol compounds such as 1,4-butanediol, polyoxypropylene glycol, polyoxyalkylene glycol, 1,1,1-trimethylolpropane and the like; polyamine compounds such as ethylenediamine, γ-hydroxypropylated ethylenediamine, phenylenediamine, hexamethylenediamine, N-aminoethylpiperazine, modified aliphatic polyamines and the like; polyepoxy 9roupcontainin9 compounds and epoxy resins, for example, as described in Hiroshi Kakiuchi "New Epoxy Resins (Shin Epoxy Jushi)" published by Shokodo (1985), and Kuniyuki Hashimoto "Epoxy Resins (Epoxy Jushi)" published by Nikkan Kogyo Shinbunsha (1969); melamine resins such as described in Ichiro Miwa and Hideo Matsunaga "Urea and Melamine Resins (Urea-Melamine Jushi)" published by Nikkan Kogyo Shinbunsha (1969); and poly(meth)acrylate compounds as described in Shin Ogawara, Takeo Saegusa and Toshinobu Higashimura "Oligomers" published by Kodansha (1976) and Eizo Omori "Functional Acrylic Resins" published by Technosystem (1985), for example, polyethylene glycol diacrylate, neopentyl glycol diacrylate, 1,6-hexanediol diacrylate, trimethylolpropane triacrylate, pentaerythritol polyacrylate, bisphenol A-diglycidyl ether diacrylate, oligoester acrylate and methacrylates thereof and the like.

In the present invention, Resin (L) containing at least one of functional groups capable of forming at least one hydrophilic group by processing with a processing solution containing a compound with nucleophilic reactivity is in the form of grains with a maximum grain diameter of at most 10 μm, preferably at most 5 μm, and an average grain diameter of at most 1.0 μm.

The resin grains of the present invention, with fine grain diameter, are produced by dispersing the resin powder as it is, when preparing the composition for forming an image receptive layer, to thus give a desired grain size. Alternately, it is possible to use a dry or wet pulverizing method well known in the art or a method of obtaining high molecular gel latexes.

That is to say, it is possible to use a known method of directly pulverizing a resin powder to give fine grains by a known grinder or dispersing machine, e.g., ball mill, paint shaker, sand mill, hammer mill, jet mill, keddy mill, etc., and a known method of producing latex grains of paints or liquid developers for electrophotography. The latter method of obtaining high molecular latex grains is a method comprising dispersing the resin powder by the joint use of a dispersing polymer, more specifically previously mixing the resin powder and dispersion aid polymer followed by pulverizing, and then dispersing the pulverized mixture in the presence of the dispersing polymer.

For example, these methods are described in "Flowing and Pigment Dispersion of Paints" translated by Kenji Ueki and published by Kyoritsu Shuppan (1971), Solomon "Chemistry of Paints", "Paint and Surface Coating Theory and Practice", Yuji Harasaki "Coating Engineering (Coating Kogaku)" published by Asakura Shoten (1971), Yuji Harasaki "Fundamental Science of Coating (Kiso Kagaku of Coating)" by Maki Shoten (1977) and Japanese Patent Laid-Open Publication Nos. 6954/1987, 115171/1987 and 75651/1987.

Furthermore, the prior art method of obtaining readily latex grains or particles by suspension polymerization or dispersion polymerization can also be used in the present invention, for example, as described in Soichi Muroi "Chemistry of High Molecular Latex (Kobunshi Latex n Kagaku)" published by Kobunshi Kankokai (1970), Taira Okuda and Hiroshi Inagaki "Synthetic Resin Emulsions (Gosei Jushi Emulsion)" published by Kobunshi Kankokai (1978), Soichi Muroi "Introduction to High Molecular Latexes (Kobunshi Latex Nyumon)" published by Kobunsha (1983).

In the present invention, it is preferable to use a method of obtaining high molecular latex grains, whereby resin grains with an average grain diameter of at most 1.0 μm can readily be obtained The latex grains of fine grain diameter with a uniform grain diameter distribution can readily be provided by a dispersion polymerization method in a non-aqueous system.

As the non-aqueous solvent for the non-aqueous system latex, there can be used any of organic solvents having a boiling point of at most 200° C., individually or in combination. Useful examples of the organic solvent are alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing 6 to 14 carbon atoms such as hexane, octane, decane, dodecane, tridecane, cyclohexane and cyclooctane, aromatic hydrocarbons such as benzene, toluene, xylene and chlorobenzene and halogenated hydrocarbons such as methylene chloride, dichloroethane, tetrachloroethane, chloroform, methylchloroform, dichloropropane and trichloroethane.

When a high molecular latex is synthesized by the dispersion polymerization method in a non-aqueous solvent system, the average grain diameter of the latex grains can readily be adjusted to at most 1 μm while simultaneously obtaining grains of monodisperse system with a very narrow distribution of grain diameters. Such a method is described in, for example, K.E.J. Barrett "Dispersion Polymerization in Organic Media" John Wiley & Sons (1975), Koichiro Murata "Polymer Processings (Kobunshi Kako)" 23, 20 (1974), Tsunetaka Matsumoto and Toyokichi Tange "Journal of Japan Adhesive Association (Nippon Setchaku Kyokaishi)" 9, 183 (1973), Toyokichi Tange "Journal of Japan Adhesive Association" 23, 26 (1987), D. J. Walbridge "NATO. Adv. Study Inst. Ser. E." No. 67, 40 (1983), British Patent No.s 893,429 and 934,038 and U.S. Pat. Nos. 1,122,397, 3,900,412 and 4,606,989, and Japanese Patent Laid-Open Publication Nos. 179751/1985 and 185963/1985.

The resin grains of the present invention form hydrophilic groups by the reaction with a hydrophilic compound with nucleophilic property through processing with an oil-desensitizing solution or dampening water used during printing. Therefore, in the lithographic printing plate precursor having a image receptive layer containing the resin grains, the hydrophilic property of non-image areas rendered hydrophilic with an oil-desensitizing solution is further increased by the above described hydrophilic groups formed in the resin grains to make clear the lipophilic property of image areas and the hydrophilic property of non-image areas and to prevent the non-image areas from adhesion of a printing ink during printing. Consequently, a number of prints with clear image quality and without background stains can be obtained.

Furthermore, in the case of the above-described resin grains a part of which is crosslinked, the solubility in water is remarkably lowered, while maintaining the hydrophilic property, to be hardly or not soluble.

Therefore, such an effect is improved that the hydrophilic property on non-image areas is more enhanced by the hydrophilic groups formed by the resin grains, and the durability is improved.

More specifically, even if the quantity of the above-described functional groups in the resin grains is decreased, the effect of improving the hydrophilic property can unchangeably be maintained, or even if printing conditions are severer, e.g., enlargement of a printing machine and fluctuation of printing pressure taking place, a number of prints with clear image quality and without background stains can be obtained.

The preferred embodiment of the present invention, using the non-aqueous solvent-dispersed resin grains, will be illustrated in detail.

In addition to the above described functional group containing monomer (A), other monomers to be copolymerized can be contained as a polymeric component. Examples of the other monomers are α-olefins, vinyl or allyl alkanates, acrylonitrile, methacrylonitrile, vinyl ether, acrylamide, methacrylamide, styrenes and heterocyclic vinyl compounds, for example, 5- to 7-membered heterocyclic compounds containing 1 to 3 non-metallic atoms other than nitrogen atoms, such as oxygen atom and sulfur atom, illustrative of which are vinylthiophene, vinyldioxane, vinylfuran and the like. Examples of these compounds are vinyl or allyl esters of alkanic acids containing 1 to 3 carbon atoms, acrylonitrile, methacrylonitrile, styrene or styrene derivatives such as vinyltoluene, butylstyrene, methoxystyrene, chlorostyrene, dichlorostyrene, bromostyrene, ethoxystyrene, etc. and the like. The present invention is not intended to be limited thereto.

As a polymeric component in the resin, the monomer (A) is generally present in a proportion of at least 30 % by weight, preferably at least 50 % by weight and more preferably, the resin is composed of only the monomer (A) and the monofunctional polymer (M).

The monofunctional polymer (M) of the present first invention will now be illustrated. It is important that the polymer characterized by containing at least recurring units containing a substituent containing silicon atom and/or fluorine atom and by having a polymerizable double bond group represented by the general formula (IV) bonded to only one end of the polymer principal chain is copolymerized with the monomer (A) and is subject to solvation and soluble in the non-aqueous solvent. That is, the polymer functions as a dispersion-stabilizing resin in the so-called non-aqueous dispersion polymerization.

The monofunctional polymer (M) of the present invention should be soluble in the non-aqueous solvent, specifically to such an extent that at least 5% by weight of the polymer is dissolved in 100 parts by weight of the solvent at 25° C.

The weight average molecular weight of the polymer (M) is generally in the range of $1\times10^3$ to $1\times10^5$, preferably $2\times10^3$ to $5\times10^4$, more preferably $3\times10^3$ to $2\times10^4$. If the weight average molecular weight of the polymer (M) is less than $1\times10^3$, the resulting dispersed resin grains tend to aggregate, so that fine grains whose average grain diameters are uniform can hardly be obtained, while if more than $1\times10^5$, the advantage of the present invention will rather be decreased that the addition thereof to an image acceptive layer results in improving the water retention while satisfying the printing property.

The polymerizable double bond group component represented by the general formula (IV), bonded to only one end of the polymer main chain in the monofunctional polymer (M), will be illustrated in the following: General Formula (IV)

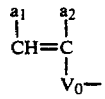

wherein $V_0$ is —O—, —COO—, —OCO—, —$CH_2$OCO—, —$CH_2$COO—, —$SO_2$—,

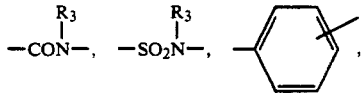

—CONHCOO— or —CONHCONH.

Herein, $R_3$ represents a hydrogen atom, or preferably an optionally substituted alkyl group containing 1 to 18 carbon atoms such as methyl, ethyl, propyl, butyl, heptyl, hexyl, octyl, decyl, dodecyl, hexadecyl, octadecyl, 2-chloroethyl, 2-bromoethyl, 2-cycanoethyl, 2-methoxycarbonylethyl, 2-methoxyethyl, 3-bromopropyl groups and the like; an optionally substituted alkenyl group containing 4 to 18 carbon atoms such as 2-methyl-1-propenyl, 2-butenyl, 2-pentenyl, 3-methyl-2-pentenyl, 1-pentenyl, 1-hexenyl, 2-hexenyl, 4-methy12-hexenyl groups and the like; an optionally substituted aralkyl group containing 7 to 12 carbon atoms such as benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl groups and the like; an optionally substituted alicyclic group containing 5 to 8 carbon atoms such as cyclohexyl, 2-cyclohexylethyl, 2-cyclopentylethyl groups and like; and an optionally substituted aromatic group containing 6 to 12 carbon atoms such as phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cycanophenyl, acetylphenyl, methoxycarbonylphenyl, ethoxycarbonylphenyl, butoxycarbonylphenyl, acetamidophenyl, propioamidophenyl, dodecyloylamidophenyl groups and the like.

When $V_0$ represents

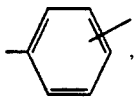

the benzene ring can have a substituent. As the substituent, there can be used halogen atoms such as chlorine, bromine atoms, etc.; alkyl groups such as methyl, ethyl, propyl, butyl, chloromethyl, methoxymethyl groups, etc.; and alkoxy groups such as methoxy, ethoxy, propioxy, butoxy groups.

$a_1$ and $a_2$ represent preferably, same or different, hydrogen atoms, halogen atoms such as chlorine, bromine atoms, etc.; cyano group; alkyl groups containing 1 to 4 carbon atoms such as methyl, ethyl, propyl, butyl groups, etc.; and —COO—$R_4$ or —COO—$R_4$ via a hydrocarbon group, wherein $R_4$ is a hydrogen atom, an alkyl group containing 1 to 18 carbon atoms, an alkenyl group, an aralkyl group, an alicyclic group or an aryl group, which can be substituted and specifically, which has the same meaning as $R_3$.

The hydrocarbon group in the above described "—COO—$R_4$ via a hydrocarbon group" includes methylene, ethylene, propylene groups, etc.

In the general formula (IV), more preferably, $Y_0$ represents —COO, —OCO—, —$CH_2$OCO—, —$CH_2$COO—, —O—, —CONH—, —$SO_2$NH— or

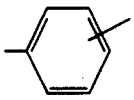

and $a_1$ and $a_2$ represent, same or different, hydrogen atoms, methyl group; —$COOR_4$ or —$CH_2COOR_4$ wherein $R_4$ is a hydrogen atom or an alkyl group containing 1 to 6 carbon atoms such as methyl, ethyl, propyl, butyl, hexyl groups, etc. Most preferably, either of $a_1$ and $a_2$ is surely a hydrogen atom.

Examples of the polymerizable double bond group represented by General Formula (IV) are as follows:

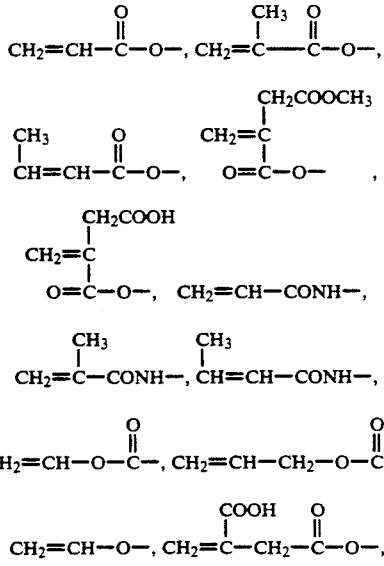

-continued

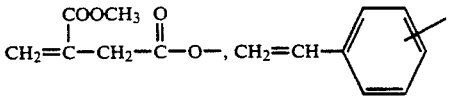

In the embodiment of the present invention, the recurring unit containing a substituent containing at least one of fluorine atom and silicon atom in the monofunctional polymer (M) will be illustrated.

The recurring units of the polymer can be of any chemical structure obtained from a radical addition-polymerizable monomer or composed of a polyester a polyether, to the side chain of which a fluorine atom and/or silicon atom is bonded.

Examples of the fluorine atom-containing substituent are —$C_hF_{2h+1}$ (h is an integer of 1 to 12), —$(CF_2)_jCF_2H$ (j is an integer of 1 to 11),

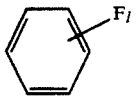

(l is an integer of 1 to 6) and the like.

Examples of the silicon atom-containing substituent are

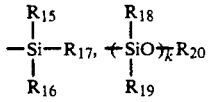

(k is an integer of 1 to 20), polysiloxane structures and the like.

In the above described substituents, $R_{15}$, $R_{16}$, and $R_{17}$represent, same or different, optionally substituted hydrocarbon groups or —$OR_{21}$ group wherein $R_{21}$ has the same meaning as the hydrocarbon group of $R_{15}$.

$R_{15}$ is an optiOnally substituted alkyl group containing 1 to 18 carbon atoms such as methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl, 2,2,2,2',2',2'-hexafluoropropyl groups, etc.; an optionally substituted alkenyl group containing 4 to 18 carbon atoms such as 2-methyl-1-propenyl, 2-butenyl, 2-pentenyl, 3-methyl-2-pentenyl, 1-pentenyl, 1-hexenyl, 2-hexenyl, 4-methyl-2-hexenyl groups, etc.; an optionally substituted aralkyl group containing 7 to 12 carbon atoms such as benzyl, phenyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl groups, etc.; an optionally substituted alicyclic group containing 5 to 8 carbon atoms such as cyclohexyl, 2-cyclohexyl, 2-cyclopentylethyl groups etc.; or an optionally substituted aromatic group containing 6 to 12 carbon atoms such as phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidephenyl, dodecyloylamidophenyl groups, etc.

In —$OR_{21}$ group, $R_{21}$ has the same meaning as $R_{15}$.

$R_{18}$, $R_{19}$ and $R_{20}$ may be same or different and have the same meaning as $R_{15}$, $R_{16}$ and $R_{17}$.

Examples of the recurring unit having a fluorine and/or silicon atom-containing substituent are given in the following without limiting the scope of the present invention.

(b-1)

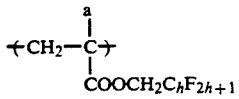

a = H, $CH_3$
h: integer of 1~12

(b-2)

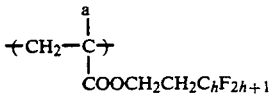

(b-3)

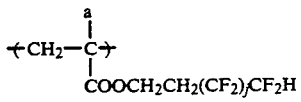

j: integer of 1~11

(b-4)

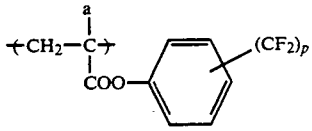

p: integer of 1~3

(b-5)

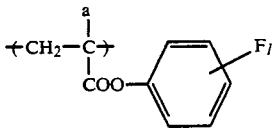

l: integer of 1~6

(b-6)

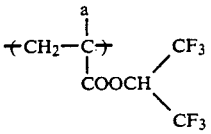

(b-7)

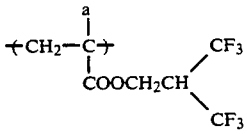

(b-8)

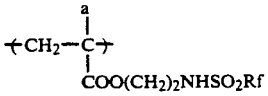

Rf: $-CH_2C_hH_{2h+1}$
$-(CH_2)_2-(CF_2)_jCF_2H$ (b-9)

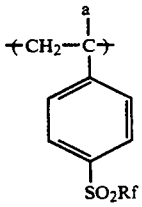

(b-10)

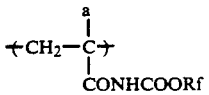

(b-11)

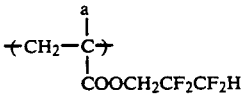

-continued (b-12)

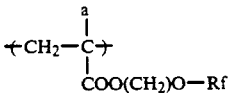

(b-13)

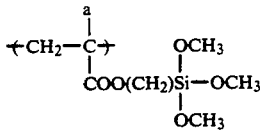

(b-14)

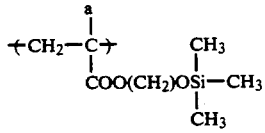

(b-15)

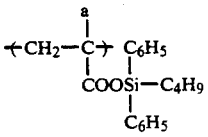

(b-16)

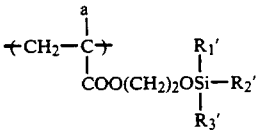

$R_1'$, $R_2'$, $R_3'$: alkyl group of $C_1$~$C_{12}$ (b-17)

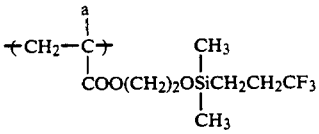

(b-18)

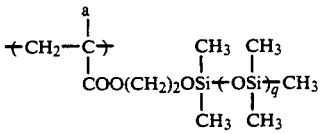

q: integer of 1~20

(b-19)

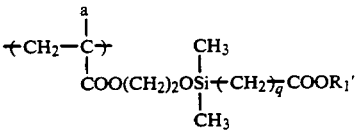

(b-20)

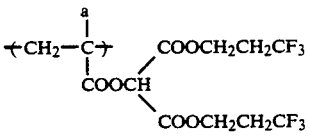

(b-21)

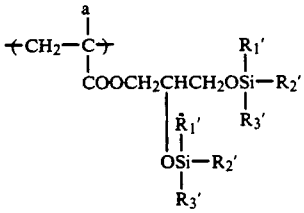

-continued (b-22)

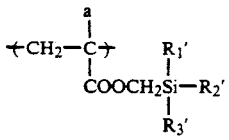

(b-23)

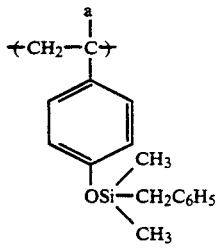

(b-24)

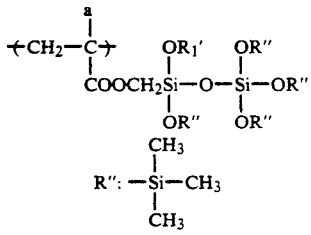

(b-25)

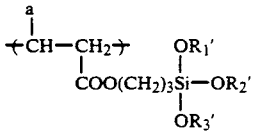

(b-26)

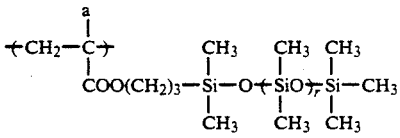

r: 30~150

(b-27)

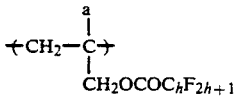

(b-28)

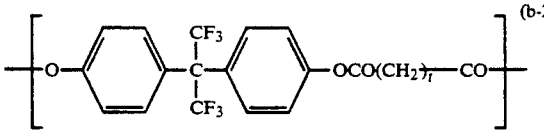

t: integer of 2~12

(b-29)

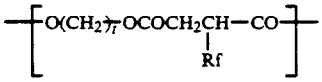

(b-30)

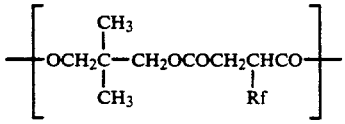

(b-31)

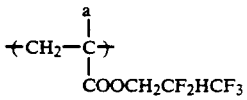

-continued (b-32)

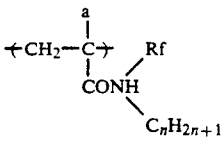

In the monofunctional polymer (M) of the present first invention, the foregoing polymerizable double bond group represented by the general formula (IV) and one end of the polymer main chain containing at least the recurring units each having a fluorine atom- and/or silicon atom-containing substituent are bonded directly or through a suitable bonding group. As the bonding group, there can be used divalent organic residual radicals, for example, divalent aliphatic groups or divalent aromatic groups, which can be bonded through a bonding group selected from the group consisting of —O—, —S—,

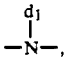

—SO—, $—SO_2—$, —COO—, —OCO—, —CONH-CO—, —NHCONH—,

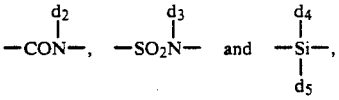

individually or in combination. $d_1$ to $d_5$ have the same meaning as $R_3$ in General Formula (IV).

Examples of the divalent aliphatic group are

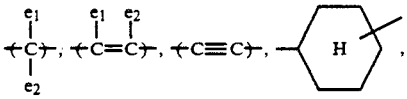

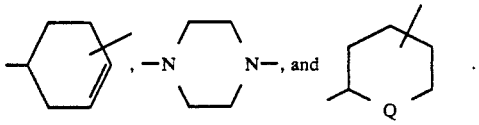

In these groups, $e_1$ and $e_2$ each represent a hydrogen atom, a halogen atom such as fluorine, chlorine and bromine atoms, etc.; or an alkyl group containing 1 to 12 carbon atoms such as methyl, ethyl, propyl, chloromethyl, bromomethyl, butyl, hexyl, octyl, nonyl, decyl groups, etc. and Q represents —O—, —S— or $—NR_{22}—$ wherein $R_{22}$ is an alkyl group containing 1 to 4 carbon atoms, $—CH_2Cl$ or $—CH_2Br$.

Examples of the divalent aromatic group are benzene ring group, naphthalene ring group and 5- or 6-membered heterocyclic ring groups each containing at least one hetero atom selected from the group consisting of oxygen atom, sulfur atom and nitrogen atom. These aromatic group can have at least one of substituents, for example, halogen atoms such as fluorine, chlorine, bromine atoms, etc.; alkyl groups containing 1 to 8 carbon atoms such as methyl, ethyl, propyl, butyl, hexyl, octyl groups, etc.; and alkoxy groups containing 1 to 6 carbon atoms such as methoxy, ethoxy, propioxy, butoxy groups, etc.

Examples of the heterocyclic ring group are furan, thiophene, pyridine, pyrazine, piperidine, tetrahydrofuran, pyrrole, tetrahydropyran, 1,3-oxazoline rings, etc.

Examples of the polymerizable double bond group represented by General Formula (IV) in the monofunctional polymer (M) and a moiety composed of the organic radical bonded thereto are given in the following without limiting the scope of the present invention, in which $P_1$ represents —H, —$CH_3$, —$CH_2COOCH_3$, —Cl, —Br or —CN, $P_2$ represents —H or —$CH_3$, X represents —Cl or —Br, n represents an integer of 2 to 12 and m represents an integer of 1 to 4.

$CH_2{=}C(P_1)-COO(CH_2)_nO-$ (C-1)

$CH(CH_3){=}CH-O(CH_2)_nO-$ (C-2)

$CH_2{=}CH-$ (C-3)

$CH_2{=}CH-CH_2-$ (C-4)

$CH_2{=}C(P_1)-COO(CH_2)_nNH-$ (C-5)

$CH_2{=}C(P_1)-COOCH_2CH(OH)CH_2O-$ (C-6)

$CH_2{=}C(P_1)-CONH(CH_2)_n$ (C-7)

$CH_2{=}CH-CH(OH)-CH_2O-$ (C-8)

$CH_2{=}C(P_1)-COOCH_2CH(SH)CH_2O-$ (C-9)

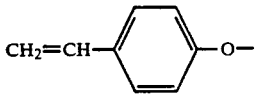
(C-10)

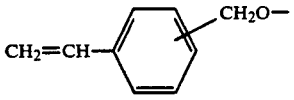
(C-11)

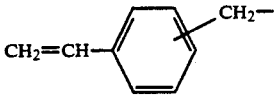
(C-12)

$CH_2{=}C(P_1)-COO(CH_2)_n$ (C-13)

$CH_2{=}C(P_1)-CONH(CH_2)_n$ (C-14)

$CH_2{=}C(P_2)-CONHCOO(CH_2)_n$ (C-15)

-continued $CH_2{=}C(P_2)-CONHCONH(CH_2)_n$ (C-16)

$CH_2{=}CH-CH_2-COO(CH_2)_n$ (C-17)

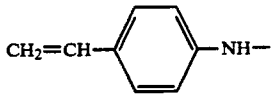
(C-18)

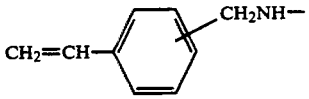
(C-19)

$CH_2{=}C(P_2)-COOCH(CH_2CH_2X)O-$ (C-20)

$CH_2{=}C(P_2)-COO(CH_2)_3NHCOO(CH_2)_n$ (C-21)

$CH_2{=}C(P_2)-COO(CH_2CH_2O)_m-CO(CH_2)_n$
$CH(CH_3){=}CH-COOCH_2CH(OH)CH_2OOC(CH_2)_m-C(CH_3)(CN)-$ (C-22)

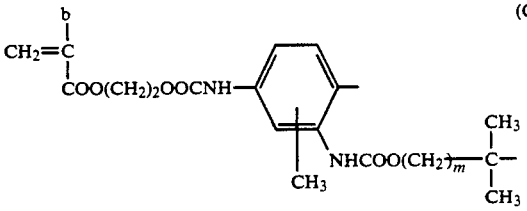
(C-23)

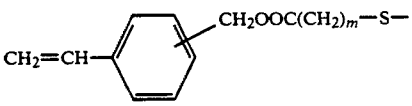
(C-24)

$CH_2{=}CH-CH_2OCO(CH_2)_m-S-$ (C-25)

$CH_2{=}CH-CH_2COO(CH_2)_m-C(CH_3)(CN)-$ (C-26)

$CH_2{=}CH-CH_2CH(OH)CH_2OOC(CH_2)_m-C(CH_3)(CN)-$ (C-27)

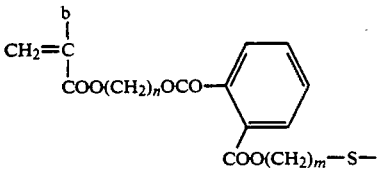
(C-28)

-continued

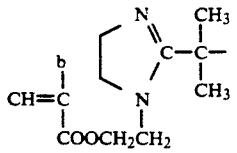

(C-29)

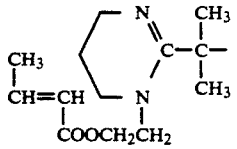

(C-30)

In the sum of the recurring units of the monofunctional polymer (M) of the present first invention, the recurring units each having a fluorine atom and/or silicon atom-containing substituent are present preferably in a proportion of at least 40% by weight, more preferably 60 to 100% by weight based on the whole quantity.

If the above described component is less than 40% by weight to the whole quantity, the concentrating effect in the surface part is deteriorated when the resin grains are dispersed in the photoconductive layer, thus decreasing the effect of improving the water retention as a printing plate precursor.

The monofunctional polymer (M) of the present invention can be produced by the synthesis method of the prior art, for example, (1) an ion polymerization method comprising reacting the end of a living polymer obtained by an anion or cation polymerization with various reagents to obtain a monofunctional polymer (M), (2) a radical polymerization method comprising reacting a polymer having an end-reactive group bonded, obtained by radical polymerization using a chain transferring agent and/or polymerization initiator containing a reactive group such as carboxyl group, hydroxyl group, amino group, etc. in the molecule with various reagents to obtain a monofunctional polymer (M), (3) a polyaddition condensation method comprising introducing a polymerizable double bond group into a polymer obtained by polyaddition or polycondensation method in the similar manner to the described above radical polymerization method and the like.

For example, these methods are described in P. Drefuss & R. P. Quirk, "Encycl. Polym. Sci. Eng.", 7, 551 (1987), P. F. Rempp, E. Franta, "Adv. Polym. Sci.", 58, (1984), V. Percec, "Appl. Poly. Sci.", 285, 95 (1984), R. Asami, M. Takari, "Makromol. Chem. Suppl.", 12, 163 (1985), P. Rempp et al., "Makromol. Chem. Suppl.", 8, (1987), Yusuke Kawakami, "Kagaku Kogyo (Chemical Industry)" 38, 56 (1987), Yuya Yamashita, "Kobunshi (Polymer)" 31, 988 (1982), Shiro Kobayashi, "Kobunshi (Polymer)" 30, 625 (1981), Toshinobu Higashimura, "Nippon Setchaku Kyokaishi (Japan Adhesive Association)" 18, 536 (1982), Koichi Ito, "Kobunshi Kako (Polymer Processing)" 35, 262 (1986), and Kishiro Azuma and Takashi Tsuda, "Kino Zairyo (Functional Materials)" 1987, No. 10, 5.

When the dispersed resin grains of the present invention have network structures, polymers composed of the above described functional group-containing monofunctional monomers (A) as a polymeric component hereinafter referred to as "polymeric component" (A)) are crosslinked with each other to form a high order network structure.

That is, the dispersed resin grains of the present invention are a non-aqueous latex composed of a part insoluble in a non-aqueous dispersing solvent, consisting of the polymeric component (A), and the monofunctional polymer (M) soluble in the solvent, and when having a network structure, the polymeric component (A) composing the insoluble part in the solvent is subject to crosslinking between the molecules thereof.

Thus, the network resin grains are hardly or not soluble in water and specifically, the solubility of the resin in water is at most 80% by weight, preferably at most 50% by weight.

The crosslinking according to the present invention can be carried out by known methods, that is, (1) method comprising crosslinking a polymer containing the polymeric component (A) with various crosslinking agents or hardening agents, (2) method comprising polymerizing a monomer corresponding to the polymeric component (A) in the presence of a multifunctional monomer or multifunctional oligomer containing two or more polymerizable functional groups to form a network structure among the molecules and (3) method comprising subjecting polymers containing the polymeric components (A) and components containing reactive groups to polymerization reaction or polymer reaction and thereby effecting crosslinking.

As the crosslinking agent in the above described method (1), there can be used compounds commonly used as crosslinking agents, for example, described in Shinzo Yamashita and Tosuke Kaneko "Handbook of Crosslinking Agents (Kakyozai Handbook)" published by Taiseisha (1981) and Kobunshi Gakkai Edition "High Molecular Data Handbook -Basis- (Kobunshi Data Handbook -Kisohen-)" published by Baihunkan (1986).

Examples of the crosslinking agent are organosilane compounds such as vinyltrimethoxysilane, vinyltributoxysilane, γ-glycidoxypropyltrimethoxysilane, γ-mercaptopropyltriethoxysilane, γ-aminopropyltriethoxysilane and other silane coupling agents; polyisocyanate compounds such as tolylene diisocyanate, o-tolylene diisocyanate, diphenylmethane diisocyanate, triphenylmethane diisocyanate, polymethylenepolyphenyl isocyanate, hexamethylene diisocyanate, isophorone diisocyanate, high molecular polyisocyanates; polyol compounds such as 1,4-butanediol, polyoxypropylene glycol, polyoxyalkylene glycol, 1,1,1-trimethylolpropane and the like; polyamine compounds such as ethylenediamine, γ-hydroxypropylated ethylenediamine, phenylenediamine, hexamethylenediamine, N-aminoethylpiperazine, modified aliphatic polyamines and the like; polyepoxy group-containing compounds and epoxy resins, for example, as described in Kakiuchi Hiroshi "New Epoxy Resins (Shin Epoxy Jushi)" published by Shokodo (1985), and Kuniyuki Hashimoto "Epoxy Resins (Epoxy Jushi)" published by Nikkan Kogyo Shinbunsha (1969); melamine resins such as described in Ichiro Miwa and Hideo Matsunaga "Urea and Melamine Resins (Urea-Melamine Jushi)" published by Nikkan Kogyo Shinbunsha (1969); and poly(-meth)acrylate compounds as described in Shin Ogawara, Takeo Saegusa and Toshinobu Higashimura "Oligomers" published by Kodansha (1976) and Eizo Omori "Functional Acrylic Resins" published by Technosyste (1985), for example, polyethylene glycol diacrylate, neopentyl glycol diacrylate, 1,6-hexanediol diacrylate, trimethylolpropane triacrylate, pentaerythritol polyacrylate, bisphenol A-diglycidyl ether diacrylate, oligoester acrylate and methacrylates thereof and the like.

Examples of the polymerizable functional group of the multifunctional monomer [hereinafter referred to as multifunctional monomer (D) sometime] or multifunctional oligomer containing at least two polymerizable functional groups, used in the above described method (2), are as exemplified in the above described monomer synthesis.

Any of monomers or oligomers containing two or more same or different ones of these polymerizable functional groups can be used in the present invention.

Of these monomers or oligomers, as the monomer or oligomer having two or more same polymerizable functional groups, there can be used styrene derivatives such as divinyl benzene and trivinyl benzene; esters of polyhydric alcohols such as ethylene glycol, diethylene glycol, triethylene glycol, polyethylene glycols Nos. 200, 400 and 600, 1,3-butylene glycol, neopentyl glycol, dipropylene glyclol, polypropylene glycol, trimethylolpropane, trimethylolethane, pentaerythritol and the like or polyhydroxyphenols such as hydroquinone, resorcinol, catechol and derivatives thereof with methacrylic acid, acrylic acid or crotonic acid, vinyl ethers and allyl ethers; vinyl esters of dibasic acids such as malonic acid, succinic acid, glutaric acid, adipic acid, pimelic acid, maleic acid, phthalic acid, itaconic acid and the like, allyl esters, vinylamides and allylamides; and condensates of polyamines such as ethylenediamine, 1,3-propylenediamine, 1,4-butylenediamine and the like with carboxylic acids containing vinyl groups such as methacrylic acid, acrylic acid, crotonic acid, allylacetic acid and the like.

As the monomer or oligomer having two or more different polymerizable functional groups, there can be used, for example, ester derivatives or amide derivatives containing vinyl groups of carboxylic acids containing vinyl group, such as methacrylic acid, acrylic acid, methacryloylacetic acid, acryloylacetic acid, methacryloylpropionic acid, acryloylpropionic acid, itaconyloylacetic acid and itaconyloylpropionic acid, reaction products of carboxylic anhydrides with alcohols or amines such as allyloxycarbonylpropionic acid, allyloxycarbonylacetic acid, 2-allyloxycarbonylbenzoic acid, allylaminocarbonylpropionic acid and the like, for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, 2-(vinyloxycarbonyl)ethyl ester of acrylic acid, N-allylacrylamide, N-allylmethacrylamide, N-allylitaconamide, methcaryloylpropionic acid allylamide and the like; and condensates of amino alcohols such as aminoethanol, 1-aminopropanol, -aminobutanol, 1-aminohexanol, 2-aminobutanol and the like with carboxylic acids containing vinyl groups.

The monomer or oligomer containing two or more polymerizable functional groups of the present invention is generally used in a proportion of at most 10 mole%, preferably at most 5 mole% to the sum of the monomer (A) and other monomers coexistent, which is polymerized to form a resin.

The crosslinking of polymers by reacting reactive groups among the polymers and forming chemical bonds according to the foregoing method (3) can be carried out in the similar manner to the ordinary reactions of organic low molecular compounds, for example, as disclosed in Yoshio Iwakura and Keisuke Kurita "Reactive Polymers (Hannosei Kobunshi)" published by Kohdansha (1977) and Ryohei Oda "High Molecular Fine Chemical (Kobunshi Fine Chemical)" published by Kohdansha (1976).

As well known in the art, for example, the polymer reactions by combination of the functional groups as classified as Groups A and B of Table 1 are carried out.

As illustrated above, the network dispersed resin grains of the present invention are polymer grains comprising polymeric components containing functional groups and polymeric components containing recurring units having fluorine atom- and/or silicon atomcontaining substituents, and having high order crosslinked structures among the molecular chains.

In the dispersion polymerization, the method (2) using the multifunctional monomer is preferred as a method of forming a network structure because of obtaining grains of monodisperse system with a uniform grain diameter and tending to obtain fine grains with a grain diameter of at most 0.5 μm.

As the non-aqueous solvent for the preparation of the non-aqueous solvent-dispersed resin grains, there can be used any of organic solvents having a boiling point of at most 200° C., individually or in combination.

Useful examples of the organic solvent are alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing 6 to 14 carbon atoms such as hexane, octane, decane, dodecane, tridecane, cyclohexane and cyclooctane, aromatic hydrocarbons such as benzene, toluene, xylene and chlorobenzene and halogenated hydrocarbons such as methylene chloride, dichloroethane, tetrachloroethane, chloroform, methylchloroform, dichloropropane and trichloroethane. The present invention is not intended to be limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of monodisperse system with a very narrow distribution of grain diameters. Such a method is described in, for example, K. E. J. Barrett "Dispersion Polymerization in Organic Media" John Wiley & Sons (1975), Koichiro Murata "Polymer Processings (Kobunshi Kako)" 23, 20 (1974), Tsunetaka Matsumoto and Toyokichi Tange "Journal of Japan Adhesive Association (Nippon Setchaku Kyokaishi)" 9, 183 (1973), Toyokichi Tange "Journal of Japan Adhesive Association" 23, 26 (1987), D. J. Walbridge "NATO. Adv. Study Inst. Ser. E." No. 67, 40 (1983), British Patent Nos. 893,429 and 934,038 and U.S. Pat. Nos. 1,122,397, 3,900,412 and 4,606,989, and Japanese Patent Laid-Open Publication Nos. 179751/1985 and 85963/1985.

The dispersed resin of the present invention consists of at least one of the monomers (A) and at least one of the monofunctional polymers (M) and optionally contains the multifunctional monomer (D) when a network structure is formed. In any case, it is important that if a resin synthesized from such a monomer is insoluble in the non-aqueous solvent, a desired dispersed resin can be obtained. More specifically, it is preferable to use 1 to 50% by weight, more preferably 5 to 25% by weight of the monofunctional monomer (M) for the monomer (A)

to be insolubilized. The dispersed resin of the present invention has a molecular weight of $10^4$ to $10^6$, preferably $10^4$ to $5\times10^5$.

Preparation of the dispersed resin grains used in the present invention is carried out by heating and polymerizing the monomer (A), monofunctional polymer (M) and further the multifunctional monomer (D) in the presence of a polymerization initiator such as benzoyl peroxide, azobisisobutyronitrile, butyllithium, etc. in a non-aqueous solvent Specifically, there are (1) a method comprising adding a polymerization initiator to a mixed solution of the monomer (A), monofunctional polymer (M) and multifunctional monomer (D), (2) a method comprising adding dropwise or suitably a mixture of the above described polymerizable compounds and polymerization initiator to a non-aqueous solvent, but of course, any other suitable methods can be employed without limiting to these methods.

The total amount of the polymerizable compounds is 5 to 80 parts by weight, preferably 10 to 50 parts by weight per 100 parts by weight of the non-aqueous solvent.

The amount of the polymerization initiator is 0.1 to 5% by weight of the total amount of the polymerizable compounds. The polymerization temperature is about 50° to 180° C., preferably 60° to 120° C. in the present invention. The reaction time is preferably 1 to 15 hours.

Thus, the non-aqueous dispersed resin prepared by the present invention becomes fine grains with a uniform grain size distribution.

As the matrix resin (binder resin) used in the image receptive layer of the present invention, there can be used all of known resins, typical of which are vinyl chloride-vinyl acetate copolymers, styrene-butadiene copolymers, styrene-methacrylate copolymers, methacrylate copolymers, acrylate copolymers, vinyl acetate copolymers, polyvinyl butyral, alkyd resins, silicone resins, epoxy resins, epoxyester resins, polyester resins and the like, and water-soluble polymers such as polyvinyl alcohol, modified polyvinyl alcohol, starch, oxidized starch, carboxymethylcellulose, hydroxyethylcellulose, casein, gelatin, polyacrylates, polyvinylpyrrolidone, vinyl ether-maleic anhydride copolymers, polyamide, polyacrylamide and the like.

The matrix resin used in the present invention has preferably a molecular weight of $10^3$ to $10^6$, more preferably $5\times10^3$ to $5\times10^5$ and a glass transition point of −10° C. to 120° C., more preferably 0° C. to 85° C.

As other components of the image receptive layer according to the present invention, there can be used inorganic pigments, for example, kaolin clay, calcium carbonate, silica, titanium oxide, zinc oxide, barium sulfate, alumina and the like.

The ratio of a binder resin/pigment in the image receptive layer, depending on the kinds of materials and the grain size of the pigment, is generally in the range of 1/(0.5 to 5), preferably 1/(0.8 to 2.5).

In addition, a crosslinking agent can be added to the image receptive layer of the present invention so as to further increase the film strength. Examples of the crosslinking agent are ammonium chloride, organic peroxides, metallic soap, organic silanes, crosslinking agents of polyurethanes and hardening agents of epoxy resins, commonly used in the art, as described in Shinzo Yamashita and Tosuke Kaneko "Crosslinking Agents Handbook (Kakyozai Handbook)" published by Taiseisha (1981).

As the base used in the present invention, there are given fine quality paper, moistened and strengthened paper, plastic films such as polyester films and metal sheets such as aluminum sheets.

In the present invention, furthermore, there can be provided an intermediate layer or interlayer between the base and image receptive layer for the purpose of improving the waterproofness and adhesiveness there between and a back coated layer (back layer) on the opposite surface of the base to the image receptive layer to prevent from curling.

The intermediate layer is 9enerally composed of, as a predominant component, at least one member of emulsion type resins such as acrylic resins, styrene-butadiene copolymers, methacrylic acid ester-butadiene copolymers, acrylonitrile-butadiene copolymers and ethylene-vinyl acetate copolymers; solvent type resins such as epoxy resins, polyvinyl butyral, polyvinyl chloride and polyvinyl acetate; and water-soluble resins as described above. If necessary, inorganic pigments and waterproofing agents can be added.

The back coated layer is generally composed of similar materials to those of the intermediate layer.

When using the printing plate precursor of the present invention for PPC, in order to reduce further background stains, dielectrics or electric conducts can be added to the image receptive layer, intermediate layer and/or back coated layer of the present invention in such a manner that the volume specific resistivity, as a printing plate precursor, becomes $10^{10}$ to $10^{13}$ Ωcm. The electric conduct includes inorganic materials, for example, salts of monovalent or polyvalent metals such as Na, K, Li, Mg, Zn, Co and Ni and organic materials, for example, cationic polymers such as polyvinyl benzyltrimethylammonium chloride and acrylic resin modified quaternary ammonium salt and anionic polymers such as polymeric sulfonates. The amount of the electric conduct imparting agent to be added is generally 3 to 40% by weight, preferably 5 to 20% by weight based on the weight of a binder used in each layer.

Production of the lithographic printing plate precursor of direct imaging type according to the present invention is generally carried out by optionally coating one side of a base with a liquid composition comprising components for the intermediate layer, followed by drying, to form an intermediate layer, then coating with a liquid composition comprising components for the image receptive layer, followed by drying, to form an image receptive layer and optionally coating the other side of the base with a liquid composition comprising components for the back coated layer, followed by drying, to form a back coated layer. The coverage quantities of the image receptive layer, intermediate layer and back coated layer are respectively 1 to 30 g/m$^2$, 5 to 20 g/m$^2$ and 5 to 20 g/m$^2$.

Production of a printing plate using the direct image lithographic printing plate precursor of the present invention can be carried out in known manner by forming and fixing a copied image on the printing plate precursor of direct image type composed as described above and subjecting the non-image area to an oil-desensitizing treatment using an oil-desensitizing solution.

The oil-desensitization of the resin grains of the present invention, containing the functional groups represented by General Formula (I) or containing formyl group, can be accomplished by processing with a solution containing a compound having hydrophilic groups capable of readily undergoing nucleophilic reaction with the double bonds in water or a water-soluble organic solvent.

The hydrophilic compound causing a nucleophilic substitution reaction with the double bond of the functional group represented by General Formula (I) or with the formyl group includes a hydrophilic compound containing a substituent having a nucleophilic constant n of at least 5.5 (Cf. R. G. Pearson, H. Sobel and J. Songstad "J. Amer. Chem. Soc." 90, 319 (1968)) and being dissolved in distilled water in a proportion of at least 1 part by weight to 100 parts by weight of distilled water, illustrative of which are hydrazines, hydroxylamine, sulfites such as ammonium, sodium, potassium and zinc sulfites, thiosulfates, mercapto compounds each containing at least one polar group selected from the group consisting of hydroxyl, carboxyl, sulfo, phosphono and amino groups in the molecules, hydrazide compounds, sulfinic acid compounds, primary amine compounds and secondary amine compounds.

Examples of the mercapto compound are 2-mercaptoethanol, 2-mercaptoethylamine, N-methyl-2-mercaptoethylamine, N-(2-hydroxyethyl)-2-mercaptoethylamine, thioglycolic acid, thiomalic acid, thiomercaptoethanesulfonic acid, 2-mercaptoethylphosphonic acid, mercaptobenzenesulfonic acid, 2-mercaptopropionylaminoacetic acid, 2-mercapto-1-aminoacetic acid, 1-mercaptopropionylaminoacetic acid, 1,2-dimercaptopropionylaminoacetic acid, 2,3-dihydroxypropylmercaptan, 2-methyl 2-mercapto-1-aminoacetic acid and the like.

Examples of the sulfinic acid are 2-hydroxyethylsulfinic acid, 3-hydroxypropanesulfinic acid, 4-hydroxybutanesulfinic acid, carboxybenzenesulfinic acid, dicarboxybenzenesulfinic acid and the like.

Examples of the hydrazide compound are 2-hydrazinoethanesulfonic acid, 4-hydrazinobutanesulfonic acid, hydrazinobenzenesulfonic acid, hydrazinobenzenedisulfonic acid, hydrazinobenzoic acid, hydrazinobenzenedicarboxylic acid and the like.

Examples of the primary or secondary amine compound are N-(2-hydroxyethyl)amine, N,N-di(2-hydroxyethyl)amine, N,N-di(2-hydroxyethyl)ethylenediamine, tri(2-hydroxyethyl)ethylenediamine, N-(2,3-dihydroxypropyl)amine, N,N-di(2,3-dihydroxypropyl)amine, 2-aminopropionic acid, aminobenzoic acid, aminopyridine, aminobenzenedicarboxylic acid, 2 hydroxyethylmorpholine, 2-carboxyethylmorpholine, 3-carboxypiperidine and the like.

The nucleophilic compounds are used in such a manner that each of them is contained in the oil-desensitization processing solution or in the processing solution for separately processing the resin grains.

The quantity of the nucleophilic compound in such a processing solution is generally 0.1 to 10 mol/l, preferably 0.5 to 5 mol/l. The processing solution has preferably a pH of at least 4. The processing condi tions are a temperature of 15° to 60° C. and a period of time of 10 seconds to 5 minutes for immersing.

In addition to the above described nucleophilic compound and pH regulating agent, the processing solution may contain other compounds, for example, water-soluble organic solvents, individually or in combination, in a proportion of 1 to 50 parts by weight to 100 parts by weight of water, examples of which are alcohols such as methanol, ethanol, propanol, propargyl alcohol, benzyl alcohol, phenethyl alcohol, etc., aromatic alcohols, ketones such as acetone, methyl ethyl ketone, acetophenone, etc., ethers such as dioxane, trioxane, tetrahydrofuran, ethylene glycol, propylene glycol, ethylene glycol monomethyl ether, propylene glycol monomethyl ether, tetrahydropyran, etc., amides such as dimethylformamide, dimethylacetamide, etc., amino alcohols such as monoethanolamine, diethanolamine, triethanolamine, etc., esters such as methyl acetate, ethyl acetate, ethyl formate, etc.

Furthermore, a surfactant can be incorporated in the processing solution in a proportion of 0.1 to 20 parts by weight to 100 parts by weight of water, illustrative of which are anionic, cationic and nonionic surfactants well known in the art, for example, described in Hiroshi Horiguchi "New Surfactants (Shin-Kaimen Kasseizai)" published by Sankyo Shuppan KK, 1975, Ryohei Oda and Kazuhiro Teramura "Synthesis of Surfactants and Applications Thereof (Kaimen Kasseizai no Gosei to sono Oyo)" published by Maki Shoten, 1980.

Furthermore, if necessary, defoaming agents and various additives can be added.

The scope of the present invention should not be construed to be limited to the above described and specified compounds.

The oil-desensitization of the resin of the present invention, containing the functional group represented by General Formula (II), is characterized in that it is rendered hydrophilic by carrying out the hydrogen halide removing reaction as shown in the foregoing Reaction Formula (1) and then subjecting the resulting double bond to nucleophilic reaction with a nucleophilic reagent.

Since the hydrogen halide removing reaction readily proceeds in a processing solution with a pH of at least 6, removing the hydrogen halide and rendering hydrophilic though the nucleophilic reaction are accomplished by adjusting the pH of the oil-desensitization processing solution containing at least the above described nucleophilic compound to 6 or more.

More preferably, the processing solution has a pH of at least 8. In addition, after the hydrogen halide removing reaction is allowed to proceed in a solution with a pH of at least 6, the oil-desensitization can be carried out with the processing solution containing the nucleophilic compound.

The oll-desensitization of the binder resin of the present invention, containing the functional group represented by the general formula (III is characterized in that it is rendered hydrophilic by carrying out the alcohol removing reaction through acid decompsition as shown in the foregoing Reaction Formula (2) and then subjecting the resulting formyl group to nucleophilic reaction with a nucleophilic reagent. The alcohol removing reaction readily proceeds in a processing solution with a pH of at most 5 and the formyl group is thus formed, followed by the nucleophilic reaction to thus render hydrophilc.

The present invention will now be illustrated in greater detail by way of examples, but it should be understood that the present invention is not limited thereto. The monofunctional polymer (M) will hereinafter be referred to as "macromonomer".

EXAMPLES

Preparation Example 1 of Resin Grains: (L-1)

A mixed solution of 95 g of dodecyl methacrylate, 5 g of acrylic acid and 200 g of toluene was heated to 70° C. while stirring under a nitrogen stream, and 1.5 g of 2,2-azobis(isobutyronitrile) (referred to as A.I.B.N.) was added thereto and reacted for 8 hours. To this reaction mixture were added 12 g of glycidyl methacrylate, 1 g of t-butylhydroquinone and 0.8 g of N,N-dimethyldodecylamine, followed by allowing the mixture to react at 100° C. for 15 hours (Dispersed Resin (P-1).

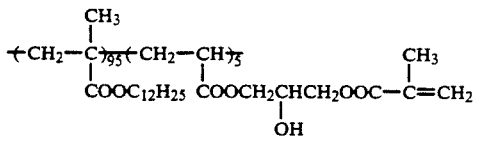
(P-1)

A mixture of 7.5 g (as solid content) of the above described Dispersed Resin (P-1), 50 g of a monomer [M-1] having the following structure and 200 g of methyl ethyl ketone was heated to 65° C. while stirring under a nitrogen stream, and 0.7 g of 2,2-azobis-(isovaleronitrile) (referred to as A. I. V. N.) was then added thereto and reacted for 6 hours.

After passage of 20 minutes from the addition of the initiator (A. I. V. N.), the homogeneous solution became slightly opaque, the reaction temperature being raised to 90° C. After cooling, the reaction product was passed through a nylon cloth of 200 mesh to obtain a white dispersion having an average grain diameter of 0.45 μm as a white latex (L-1).

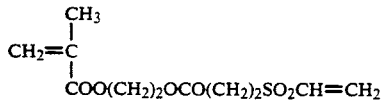
Monomer [M-1]

PREPARATION EXAMPLE 2 OF RESIN GRAINS (L-2)

A mixture of 20 g of a monomer (M-2) having the following structure, 8 g of Dispersed Resin (P-1) (as solid content), 150 g of ethyl acetate and 150 g of n-hexane was heated to 55° C. while stirring under a nitrogen stream, and 0.5 g of A. I. V. N. was added thereto and reacted for 4 hours, thus obtaining a white dispersion. After cooling, the reaction product was passed through a nylon cloth of 200 mesh. The resulting dispersion was a latex [L-2] with an average grain diameter of 0.30 μm.

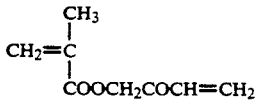
Monomer [M-2]

PREPARATION EXAMPLE 3 OF RESIN GRAINS: (L-3)

Preparation Example 1 was repeated except using a mixed solution of 20 g of a monomer (M-3) having the following structure, 5 g of a macromonomer (P-2) having the following structure and 150 g of methyl ethyl ketone, thus obtaining a white latex (L-3) having a mean grain diameter of 0.30 μm.

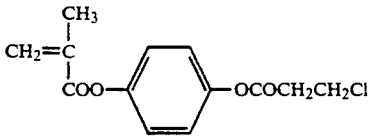
Monomer [M-3]

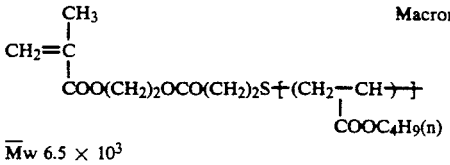
Macromonomer [P-2]

$\overline{M}w$ 6.5 × $10^3$

PREPARATION EXAMPLE 4 OF RESIN GRAINS: (L-4)

Preparation Example 1 was repeated except using a mixed solution of 20 g of a monomer (M-4) having the following structure, 2.0 g of divinylbenzene, 6 g of a macromonomer (P-3) havinq the following structure and 150 g of methyl isobutyl ketone, thus obtaining a white latex (L-4) having a mean grain diameter of 0.25 μm.

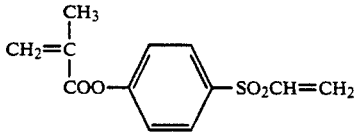
Monomer [M-4]

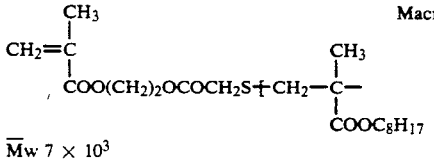
Macromonomer [P-3]

$\overline{M}w$ 7 × $10^3$

PREPARATION EXAMPLE 5 OF RESIN GRAINS: (L-5)

Preparation Example 1 was repeated except using a mixed solution of 20 g of a monomer (M-5) having the following structure, 2.5 g of ethylene glycol diacrylate, 5 g of acrylic acid, 6 g of the macromonomer P-2 and 200 g of methyl ethyl ketone, thus obtaining a white latex (L-5) having a mean grain diameter of 0.20 μm.

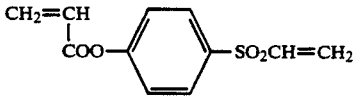
Monomer [M-5]

PREPARATION EXAMPLES 6 TO 13 OF RESIN GRAINS: (L-6) TO (L-13)

Preparation Example 4 was repeated except using monomers described in the following Table 2 instead of Monomer (M-4), thus obtaining resin grains (L-6) to (L13).

TABLE 2

| Preparation Example | Resin Grain | | Monomer (M) | Mean grain diameter of Grains |
|---|---|---|---|---|
| 6 | (L-6) | (M-6) | $CH_2{=}C(CH_3)COO(CH_2)_2SO_2CH{=}CH_2$ | 0.30 μm |
| 7 | (L-7) | (M-7) | 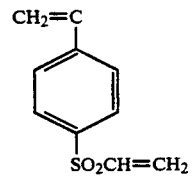 | 0.25 |
| 8 | (L-8) | (M-8) | 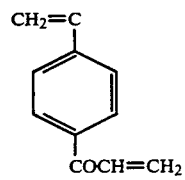 | 0.35 |
| 9 | (L-9) | (M-9) | 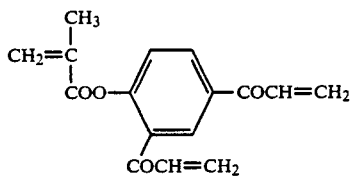 | 0.40 |
| 10 | (L-10) | (M-10) | 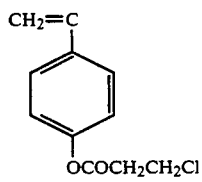 | 0.40 μm |
| 11 | (L-11) | (M-11) | $CH_2{=}CH(COO(CH_2)_3SO_2CH{=}CH_2)$ | 0.20 |
| 12 | (L-12) | (M-12) | 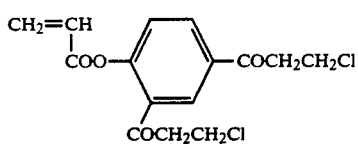 | 0.25 |
| 13 | (L-13) | (M-13) | 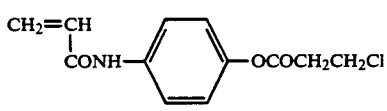 | 0.50 |

PREPARATION EXAMPLES 14 TO 20 OF RESIN GRAINS: (L-14) TO (L-20)

Preparation Example 1 was repeated except using a mixed solution of 20 g of a monomer (M) of the following Table 3, predetermined amounts of monomers for crosslinking, 5 g of a macromonomer (P-4) having the following structure and 200 g of methyl ethyl ketone, thus obtaining latexes (L-14) to (L-20).

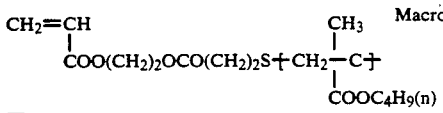

Macromonomer [P-4]

$\overline{M}w$ 6.5 × $10^3$

TABLE 3

| Preparation Example | Resin Grain | Monomer (M) | | Monomer for Crosslinking | Mean grain diameter of Grains |
|---|---|---|---|---|---|
| 14 | (L-14) | (M-14) | $CH_2=C(CH_3)COOCH_2COCH_2CH_2Br$ | divinylbenzene 2 g | 0.30 μm |
| 15 | (L-15) | (M-15) | $CH_2=CH-COO(CH_2)_2SO_2CH=CH_2$ | trivinylbenzene 1.6 g | 0.40 |
| 16 | (L-16) | (M-16) | $CH_2=C(CH_3)COOCH_2COCH_2CH_2Cl$ | ethylene glycol dimethacryalate 2.5 g | 0.20 |
| 17 | (L-17) | (M-17) | $CH_2=CH-COO-C_6H_4-SO_2CH=CH_2$ | ethylene glycol dimethacryalate 2.5 g | 0.35 |
| 18 | (L-18) | (M-1) | | divinylbenzene 1.8 g | 0.30 |
| 19 | (L-19) | (M-1) | | Propylene glycol dimethacrylate 2.2 g | 0.40 |
| 20 | (L-20) | (M-18) | $CH_3-CH=CH-COOCH_2COCH_2CH_2Cl$ | dinvinylbenzene 1.9 g | 0.60 |

PREPARATION EXAMPLE 21 OF RESIN GRAINS; (L-21)

A mixture of 7.5 g (as solid content) of the above described Dispersed Resin (P-1), 50 g of a monomer (M-19) having the following structure and 200 g of methyl ethyl ketone was heated to 65° C. while stirring under a nitrogen stream, and 0.7 g of A. I. V. N. was then added thereto and reacted for 6 hours.

After passage of 20 minutes from the addition of the initiator (A. I. V. N.), the homogeneous solution became slightly opaque, the reaction temperature being raised to 90° C. After cooling, the reaction product was passed through a nylon cloth of 200 mesh to obtain a white dispersion having an average grain diameter of 0.45 μm as a white latex (L-21).

Monomer (M-19)

$$CH_2=C(CH_3)COOCH_2CHCHO$$

PREPARATION EXAMPLE 22 OF RESIN GRAINS: (L-22)

A mixture of 20 g of a monomer (M-20) having the following structure, 8 g of Dispersed Resin (P-1) (as solid content), 150 g of ethyl acetate and 150 g of n-hexane was heated to 55° C. while stirring under a nitrogen stream, and 0.5 g of A. I. V. N. was added thereto and reacted for 4 hours, thus obtaining a white dispersion. After cooling, the reaction product was passed through a nylon cloth of 200 mesh. The resulting dispersion was a latex (L-22) with an average grain diameter of 0.30 μm.

Monomer (M-20)

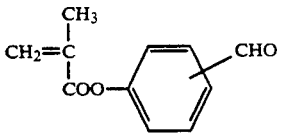

PREPARATION EXAMPLE 23 OF RESIN GRAINS; (L-23)

Preparation Example 21 was repeated except using a mixed solution of 20 g of acrolein, 5 g of the above described macromonomer (P-2) having the following structure and 150 g of methyl ethyl ketone, thus obtaining a white latex (L-23) with a mean grain diameter of 0.30 μm.

PREPARATION EXAMPLE 24 OF RESIN GRAINS: (L-24)

Preparation Example 21 was repeated except using a mixed solution of 20 g of acrolein, 2.0 g of divinylbenzene, 6 g of the macromonomer (P-5) having the following structure and 180 g of methyl isobutyl ketone, thus obtaining a white latex (L-24) with a mean grain diameter of 0.25 μm.

Macromonomer (P-5)

-continued

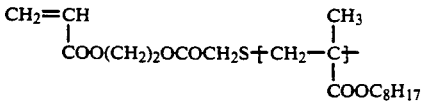

$\overline{M}W$ $5.5 \times 10^3$

PREPARATION EXAMPLES 25 AND 26 OF RESIN GRAINS: (L-25) TO (L-36)

Preparation Example 23 was repeated except using a mixed solution of 20 g of each monomer (M) shown in the following Table 4, a predetermined amount of a crosslinking monomer, 5 g of the macromonomer (P-4) and 200 g of methyl ethyl ketone, thus obtaining latexes (L-25 ) to (L-36).

PREPARATION EXAMPLE 1 OF MACROMONOMER: (M'-1)

A mixed solution of 95 g of 2,2,2,2',2',2'-hexafluoroisopropyl methacrylate, 5 g of thioglycolic acid and 200 g of toluene was heated at a temperature of 70° C. under a nitrogen stream, to which 1.0 g of A.I.B.N. was then added, followed by reacting for 8 hours. 8 g of glycidyl methacrylate, 1.0 g of N,N-dimethyldodecylamine and 0.5 g of t-butylhydroquinone were then added to the reaction solution and stirred at a temperature of 100° C. for 12 hours. After cooling, the reaction solution was subjected to reprecipitation in 2000 ml of methanol to obtain 82 g of white powder. A polymer (M'-1) had a weight average molecular weight (referred to as $\overline{M}w$) of 4000.

TABLE 4

| Preparation Example | Resin Grains | Monomer (M) (weight ratio) | | Crosslinking Monomer (g) | | Average Grain Diameter of Grains |
|---|---|---|---|---|---|---|
| 25 | (L-25) | acrolein | (100) | ethylene glycol dimethyacrylate | (3 g) | 0.30 μm |
| 26 | (L-26) | acrolein | (100) | trivinylbenzene | (1.2 g) | 0.20 μm |
| 27 | (L-27) | acrolein<br>2-hydroxyethyl methacrylate | (80)<br>(20) | dinvinylbenzene | (1.8 g) | 0.25 μm |
| 28 | (L-28) | 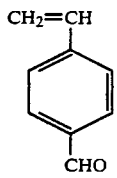 | (100) | divinylbenzene | (1.8 g) | 0.33 μm |
| 29 | (L-29) | 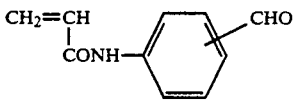 | (100) | — | (0 g) | 0.45 μm |
| 30 | (L-30) | 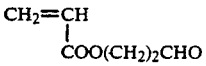 | (100) | ethylene glycol diacrylate | (1.5 g) | 0.30 μm |
| 31 | (L-31) | 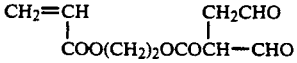 | (100) | — | (0 g) | 0.30 μm |
| 32 | (L-32) | 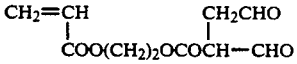 | (100) | propylene glycol diacrylate | (1.8 g) | 0.28 μm |
| 33 | (L-33) | 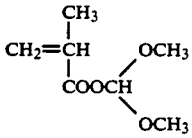 | (100) | divinylbenzene | (2.0 g) | 0.15 μm |
| 34 | (L-34) | 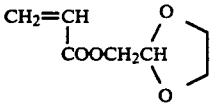 | (100) | divinylbenzene | (2.0 g) | 0.15 μm |
| 35 | (L-35) | 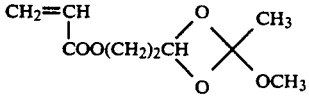 | (100) | — | (0 g) | 0.18 μm |
| 36 | (L-36) | methacrolein | (100) | divinylbenzene | (2.0 g) | 0.28 μm |

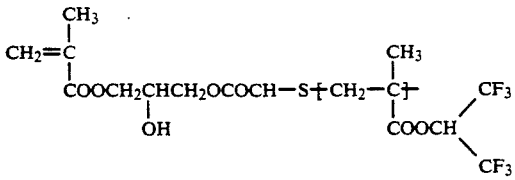

(M'-1)

PREPARATION EXAMPLE 2 OF MACROMONOMER (M'-2)

A mixed solution of 96 g of a monomer (A-1) having the following structure, 4 g of β-mercaptopropionic acid and 200 g of toluene was heated at a temperature of 70° C. under a nitrogen stream, to which 1.0 g of A.I.B.N. was added, followed by reacting for 8 hours. The reaction solution was then cooled to 25° C. in a water bath, to which 10 g of 2-hydroxyethyl methacrylate was added. A mixed solution of 15 g of dicyclohexylcarbonamide (referred to as D.C.C.), 0.2 g of 4-(N,N-dimethylamino)pyridine and 50 g of methylene chloride was dropwise added thereto with agitation for 30 minutes and further stirred for 4 hours. 5 g of formic acid was then added thereto, stirred for 1 hour, the precipitated insoluble material was separated by filtration and the filtrate was subjected to reprecipitation in 1000 ml of n-hexane. The precipitated viscous product was collected by decantation, dissolved in 100 ml of tetrahydrofuran and after separating insoluble materials by filtration, the solution was subjected to reprecipitation in 1000 ml of n-hexane. The viscous precipitate was dried to obtain a polymer (M'-2) having an $\overline{M}w$ of $5.2\times10^3$ with a yield of 60 g.

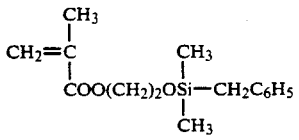

(A-1)

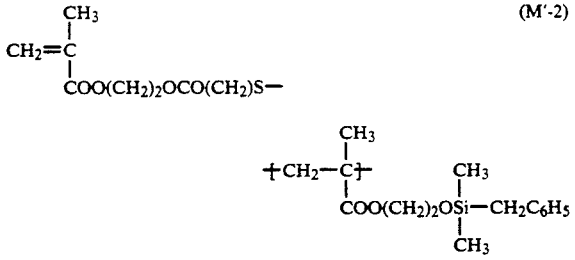

(M'-2)

PREPARATION EXAMPLE 3 OF MACROMONOMER (M'-3)

A mixed solution of 95 g of a monomer (A-2) having the following structure, 150 g of benzotrifluoride and 50 g of ethanol was heated at a temperature of 75° C. under a nitrogen stream with asgitation, to which 2 g of 4,4'-azobis(4-cyanovaleric acid) (referred to aas A.C.V.) was added, followed by reacting for 8 hours. After cooling, the reaction solution was subjected to reprecipitation in 1000 ml of methanol to obtain a polymer, which was dried. 50 g of this polymer and 11 g of 2-hydroxyethyl methacrylate were dissolved in 150 g of benzotrifluoride the temperature being adjusted to 25° C. To this mixture was dropwise added with agitation a mixed solution of 15 g of D.C.C., 0.1 g of 4-(N,N-dimethylaminopyridine and 30 g of methylene chloride was dropwise added for 30 minutes and further stirred for 4 hours as it was. 3 g of formic acid was then added thereto, stirred for 1 hour, the precipitated insoluble material was separated by filtration and the filtrate was subjected to reprecipitation in 800 ml of methanol. The precipitated product was collected, dissolved in 150 g of benzotrifluoride and again subjected to reprecipitation to obtain 30 g of a viscous product, i.e. polymer (M'-3) having an $\overline{M}w$ of $3.3\times10^4$.

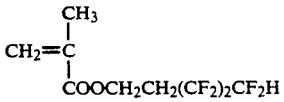

(A-2)

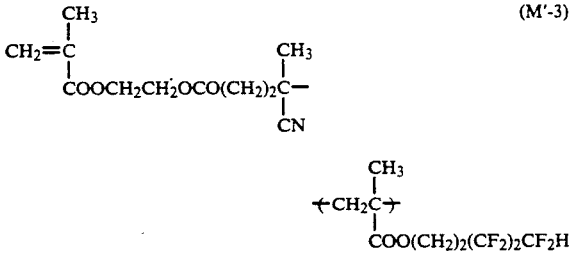

(M'-3)

PREPARATION EXAMPLES 4 TO 22 OF MACROMONOMERS (M'-4) TO (M'-22)

The procedure of Preparation Example 2 was repeated except using other monomers (monomers corresponding to polymeric components described in Table 5) instead of the monomer (A-1) of Preparation Example 2, thus preparing macromonomers (M'), each having an $\overline{M}w$ of $4\times10^3$ to $6\times10^3$.

TABLE 5

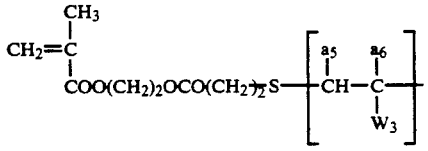

| Preparation Example of Macromonomer | Macromonomer | $a_5$ | $a_6$ | $-W_3$ |
|---|---|---|---|---|
| 4 | (M'-4) | H | $CH_3$ | $-COOCH_2CF_3$ |
| 5 | (M'-5) | H | $CH_3$ | $-COO(CH_2)_2(CF_2)_4CF_2H$ |
| 6 | (M'-6) | H | $CH_3$ | $-COO(CH_2)_2OCOC_3F_7$ |
| 7 | (M'-7) | $CH_3$ | H | $-COO(CH_2)_2(CF_2)_6CF_2H$ |
| 8 | (M'-8) | H | H | $-COO(CH_2)_2C_4F_9$ |

TABLE 5-continued
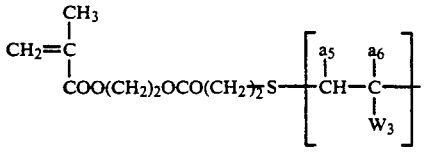
| Preparation Example of Macromonomer | Macromonomer | $a_5$ | $a_6$ | $-W_3$ |
|---|---|---|---|---|
| 9 | (M'-9) | H | $CH_3$ | $-COO(CH_2)_2Si(OCH_3)_3$ |
| 10 | (M'-10) | H | $CH_3$ | $-COOSi(C_4H_9)_2CH_2C_6H_5$ |
| 11 | (M'-11) | H | H | $-COOCH_2Si(CH_3)_2-O-Si(CH_3)_3$ |
| 12 | (M'-12) | H | H | $-COO(CH_2)_2NHSO_2C_4F_9$ |
| 13 | (M'-13) | H | $CH_3$ | $-COOCH_2CH_2CF_3$ |
| 14 | (M'-14) | H | $CH_3$ | $-COOCH(COOCH_2CF_3)_2$ |
| 15 | (M'-15) | H | $CH_3$ | 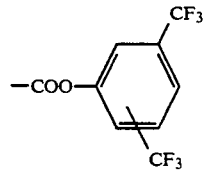 |
| 16 | (M'-16) | H | H | 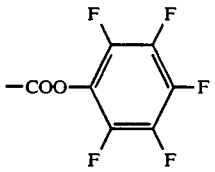 |
| 17 | (M'-17) | H | H | $-CH_2OCOC_3F_7$ |
| 18 | (M'-18) | H | H | 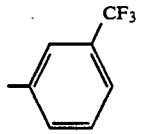 |
| 19 | (M'-19) | H | H | 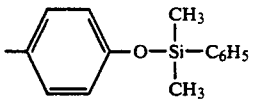 |
| 20 | (M'-20) | H | H | $-COOCH_2CH(OCOC_2F_5)CH_2OCOC_2F_5$ |
| 21 | (M'-21) | H | $CH_3$ | $-COO(CH_2)_3OSi(C_2H_5)_2CH_2CH_2CF_3$ |

TABLE 5-continued

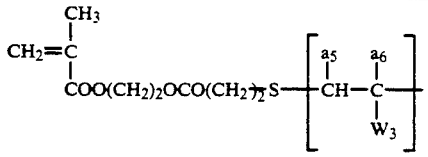

| Preparation Example of Macromonomer | Macromonomer | $a_5$ | $a_6$ | $-W_3$ |
|---|---|---|---|---|
| 22 | (M'-22) | $CH_3$ | H | 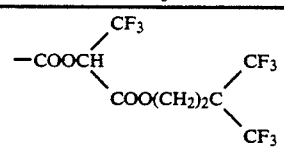 |

PREPARATION EXAMPLES 23 TO 30 OF MACROMONOMERS (M'-23) to (M'-30)

The procedure of Preparation Example 2 was repeated except using compounds corresponding to polymers described in Table 6 instead of the monomer (A-1) and 2-hydroxyethyl methacrylate of Preparation Example 2, thus preparing macromonomers (M'), each having an Mw of $5\times10^3$ to $6\times10^3$.

TABLE 6

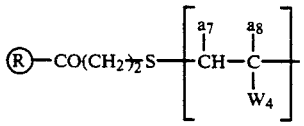

| Preparation Example of Macromonomer | Macromonomer | Ⓡ— | $a_7$ | $a_8$ | $-W_4$ |
|---|---|---|---|---|---|
| 23 | (M'-23) | 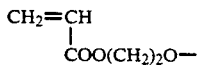 | H | $CH_3$ | 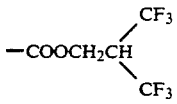 |
| 24 | (M'-24) | 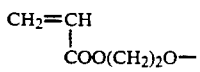 | H | $CH_3$ | 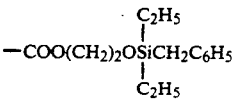 |
| 25 | (M'-25) | 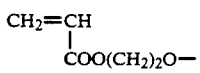 | $CH_3$ | H | $-CH_2COO(CH_2)_2(CF_2)_2CF_2H$ |
| 26 | (M'-26) | 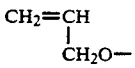 | H | $CH_3$ | 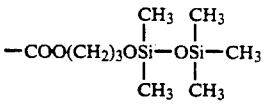 |
| 27 | (M'-27) | 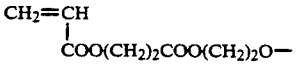 | H | $CH_3$ | 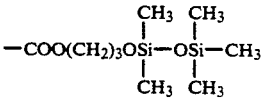 |
| 28 | (M'-28) | 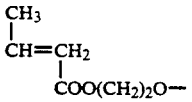 | H | H | $-COO(CH_2)_2OCOC_4F_9$ |
| 29 | (M'-29) | 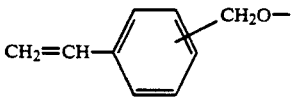 | H | $CH_3$ | $-COO(CH_2)_2OCOC_4F_9$ |
| 30 | (M'-30) | 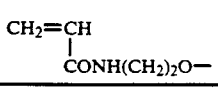 | H | H | 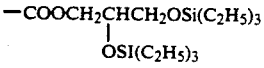 |

PREPARATION EXAMPLE 37 OF RESIN GRAINS: (L-37)

A mixed solution of 20 g of a monomer (A-1) having the following structure, 5 g of the polymer (M'-1) of Preparation Example 1 of Macromonomer and 110 g of methyl ethyl ketone was heated at a temperature of 60° C. under a nitrogen stream. 0.2 g of A.I.V.N. was added thereto and reacted for 2 hours. Further, 0.1 g of A.I.V.N. was added thereto and reacted for 2 hours. The thus resulting dispersion was filtered through a nylon cloth of 200 mesh to obtain resin grains (L-37) with a polymerization ratio of 100% and a mean grain diameter of 0.25 μm (as measured by CAPA 500 -commercial name-manufactured by Horiba Seisakujo KK).

Monomer (A-1):

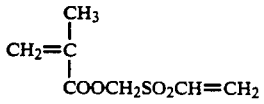

PREPARATION EXAMPLE 38 OF RESIN GRAINS: (L-38)

Preparation Example 37 of Resin Grains was repeated except using a mixed solution of 20 g of a monomer (A-2) having the following structure, 5 g of Macromonomer AK-5 (commercial name, commercially available article as a macromonomer of polysiloxane structure manufactured by Toa Gosei KK), 2 g of divinylbenzene and 120 g of methyl ethyl ketone. The resulting dispersion (L-38) had a polymerization ratio of 100% and an average grain diameter of 0.30 μm.

Monomer (A-2):

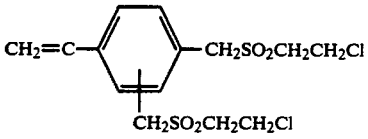

PREPARATION EXAMPLES 39 TO 47 OF RESIN GRAINS: (L-39) to (L-47)

Preparation Example 37 of Resin Grains was repeated except using a mixed solution of 20 g of monomers (A), 4 g of macromonomers (M') and 150 g of organic solvents as shown in Table 7 to prepare dispersed resin grains each having a polymerization ratio of 95 to 100% and an average grain diameter of 0.15 to 0.30 μm.

TABLE 7

| Preparation Example of Resin Grains | | Monomer (A) | Macromonomer (M') | Solvent |
|---|---|---|---|---|
| 39 | (A-3) | 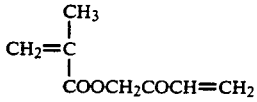 | AK-5 | methyl ethyl ketone |
| 40 | (A-4) | 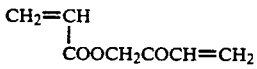 | M'-4 | methyl ethyl ketone |
| 41 | (A-5) | 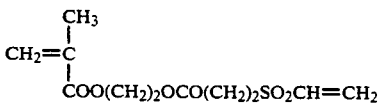 | M'-6 | ethyl acetate/n-hexane (1/1) |
| 42 | (A-6) | 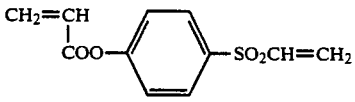 | M'-7 | methyl ethyl ketone |
| 43 | (A-7) | 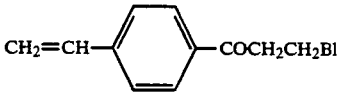 | M'-8 | ethyl acetate |
| 44 | (A-8) | 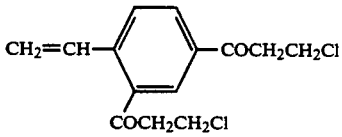 | M'-9 | methyl propyl ketone |
| 45 | (A-9) | 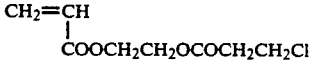 | M'-12 | ethyl acetate |
| 46 | (A-10) | 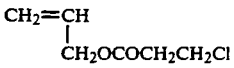 | M'-14 | methyl ethyl ketone |

TABLE 7-continued

| Preparation Example of Resin Grains | | Monomer (A) | Macromonomer (M') | Solvent |
|---|---|---|---|---|
| 47 | (A-11) | $CH_2{=}CH$<br>\|<br>$CH_2CO_2CH_2CH_2Br$ | M'-15 | n-butanol |

PREPARATION EXAMPLES 48 TO 54 OF RESIN GRAINS: (L-48) to (L-54)

Preparation Example 37 of Resin Grains was repeated except using monomers (A), monomers for crosslinking and macromonomers [M'] as shown in Table 8 to prepare resin grains each having a polymerization ratio of 95 to 100% and a mean grain diameter of 0.25 to 0.35 μm.

TABLE 8

| Preparation Example of Resin Grains | | Monomer (A) | Macromonomer | (M') | Monomer for Cross-linking | |
|---|---|---|---|---|---|---|
| 48 | (A-3) | | (M'-25) | 5 g | divinylbenzene | 2 g |
| 49 | (A-4) | | (M'-23) | 6 g | ethylene glycol dimethacrylate | 1.5 g |
| 50 | (A-12) | $CH_2{=}CH$<br>\|<br>$COO(CH_2)_2SO_2CH{=}CH_2$ | (M'-5) | 5 g | ethylene glycol diacrylate | 1.0 g |
| 51 | (A-11) | | (M'-26) | 8 g | allyl methacrylate | 3 g |
| 52 | (A-8) | | (M'-19) | 6 g | trivinylbenzene | 1.4 g |
| 53 | (A-13) | $CH_2{=}CH$<br>\|<br>$COCH_2CH_2Br$ | (M'-26) | 7 g | vinyl methacrylate | 1.5 g |
| 54 | (A-5) | | (M'-17) | 5 g | propylene glycol diacrylate | 2.5 g |

PREPARATION EXAMPLE 55 OF RESIN GRAINS: (L-55)

A mixed solution of 20 g of acrolein, 6 g of the polymer (M'-1) of Preparation Example 1 of Macromonomer and 110 g of methyl ethyl ketone was heated at a temperature of 60° C. under a nitrogen stream. 0.2 g of A.I.V.N. was added thereto and reacted for 2 hours. Further, 0.1 g of A.I.V.N. was added thereto and reacted for 2 hours. The thus resulting dispersion was filtered through a nylon cloth of 200 mesh to obtain resin grains (L-55) with a polymerization ratio of 100% and a mean grain diameter of 0.20 μm (as measured by CAPA 500 -commercial name- manufactured by Horiba Seisakujo KK).

PREPARATION EXAMPLE 56 OF RESIN GRAINS: (L-56)

Preparation Example 55 of Resin Grains was repeated except using a mixed solution of 20 g of acrolein, 5 g of Macromonomer AK-5 (commercial name, commercially available article as a macromonomer of polysiloxane structure manufactured by Toa Gosei KK), 2 g of divinylbenzene and 120 g of methyl ethyl ketone. The resulting dispersion (L-56) had a polymerization ratio of 100% and an average grain diameter of 0.30 μm.

PREPARATION EXAMPLE 57 OF RESIN GRAINS: (L-57)

A mixed solution of 20 g of a monomer (A-14) having the following structure, 8 g (as solid) of the macromonomer (M'-4), 150 g of ethyl acetate and 150 g of n-hexane was heated at a temperature of 55° C. under a nitrogen stream while stirring. 0.5 g of A.I.V.N. was added thereto and reacted for 4 hours to obtain a white dispersion. After cooling, the thus resulting dispersion was filtered through a nylon cloth of 200 mesh to obtain a white dispersion (L-57), i.e., latex with a mean grain diameter of 0.28 μm. (A-14):

(A-14):

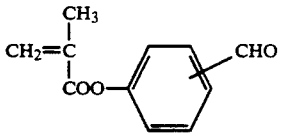

PREPARATION EXAMPLES 58 TO 69 OF RESIN GRAINS: (L-58) TO (L-69)

Preparation Example 55 of Resin Grains was repeated except using a mixed solution of 20 g of monomers (A), predetermined amounts of monomers for crosslinking, 5 g of macromonomers (M') and 200 g of methyl ethyl ketone as shown in Table 9 to prepare latexes.

TABLE 9

| Preparation Example | Resin Grains | Monomer (A) | g | Macromonomer (M) | g | Monomer for Crosslinking | g | Mean Grain Diameter of Grains |
|---|---|---|---|---|---|---|---|---|
| 58 | (L-58) | acrolein | 100 g | (M'-2) | 6 g | ethylene glycol dimethacrylate | 3 g | 0.30 μm |

TABLE 9-continued

| Preparation Example | Resin Grains | Monomer (A) | g | Macromonomer (M) | g | Monomer for Crosslinking | g | Mean Grain Diameter of Grains |
|---|---|---|---|---|---|---|---|---|
| 59 | (L-59) | acrolein | 100 g | (M'-6) | 6 g | trivinylbenzene | 1.2 g | 0.20 μm |
| 60 | (L-60) | acrolein<br>2-hydroxyethyl methacrylate | 80 g<br>20 g | (M'-10) | 5 g | divinylbenzene | 1.8 g | 0.25 μm |
| 61 | (L-61) | 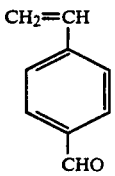 | 100 g | (M'-12) | 6 g | divinylbenzene | 1.8 g | 0.33 μm |
| 62 | (L-62) | 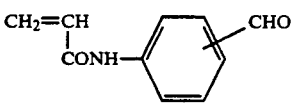 | 100 g | (M'-14) | 8 g | — | 0 g | 0.45 μm |
| 63 | (L-63) | 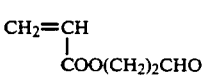 | 100 g | (M'-17) | 5 g | ethylene glycol diacrylate | 1.5 g | 0.30 μm |
| 64 | (L-64) | 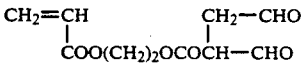 | 100 g | (M'-24) | 8 g | vinyl acrylate | 2.5 g | 0.30 μm |
| 65 | (L-65) | 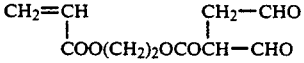 | 100 g | (M'-27) | 8 g | propylene glycol diacylate | 1.6 g | 0.28 μm |
| 66 | (L-63) | 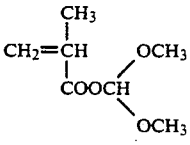 | 100 g | (M'-20) | 6 g | divinylbenzene | 2.0 g | 0.15 μm |
| 67 | (L-67) | 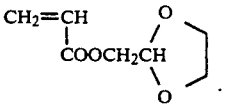 | 100 g | (M'-3) | 6.5 g | divinylbenzene | 2.0 g | 0.15 μm |
| 68 | (L-68) | 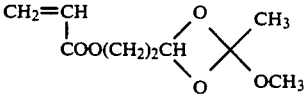 | 100 g | (M'-21) | 5 g | — | 0 g | 0.18 μm |
| 69 | (L-69) | methacrolein | 100 g | (M'-26) | 8 g | divinylbenzene | 2 g | 0.28 μm |

EXAMPLE 1

Using a fine quality paper coated with, on one side thereof, a back layer and on the other side thereof, an intermediate layer, onto the intermediate layer was coated a dispersion obtained by ball milling for 2 hours a mixture of 35 g of a resin (S-1) having the following structure, 5 g (as solid) of the resin grains (L-1), 50 g of zinc oxide and 150 g of toluene and further ball milling for 10 minutes after adding 4 g of glutaric anhydride to give a dry coverage of 18 g/m$^2$ by means of a wire bar coater, followed by drying at 100° C. for 30 seconds and further heating at 120° C. for 1 hour and 30 minutes to prepare a lithographic printing plate precursor.

Resin (S-1)

-continued

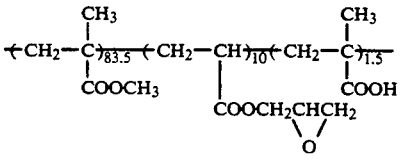

$\overline{M}w$ : 4 × 10$^4$
(weight ratio)

The resulting precursor was immersed for 3 minutes in an oil-desensitizing solution (E-1) prepared by the following recipe and washed with water:

| Oil-desensitizing Solution (E-1) | |
|---|---|
| Ammonium Sulfite | 85 g |
| Methyl Ethyl Ketone | 80 g |
| ELP-FS (commercial name, made by | 835 g |

-continued

| Oil-desensitizing Solution (E-1) |
|---|
| Fuji Photo & Film Co., Ltd.) |

On the thus oil-desensitized surface was placed 2 μl of a drop of distilled water and the contact angle between the surface and water was measured by a goniometer to obtain a contact angle with water of at most 10°. Before the oil-desensitizing processing, it was 98°. This tells that a non-image area on the image receptive layer in the precursor of the present invention was changed form lipophilic to hydrophilic. Ordinarily, it is required that such a degree of rendering hydrophilic that a non-image area does not produce background stains or spot-like stains during printing corresponds a contact angle with water of 20° or less.

The precursor was subjected to plate making by means of a commercially available PPC and then to an oil-desensitizing processing under similar conditions to those described above to obtain a printing master plate.

The resulting master plate had an image area with a density of at least 1.0 and clear image quality and a non-image area free from background stains, and was subjected to printing on fine quality papers using an offset printing machine (Oliver 52 type -commercial name-, manufactured by Sakurai Seisakusho KK). More than 3000 prints could by obtained without any problem on the background stains of non-image areas and the image quality of image areas.

Furthermore, when the above described precursor was subjected to plate making by a commercially available plain paper copy machine (PPC) under ambient conditions of 30° C. and 80% RH, the resulting master plate had an image area with a density of at least 1.0 and clear image quality and a non-image area free from background stains. When it was subjected to printing in the same manner as described above, there arose no problem ever after printing 3000 prints or more.

As apparent from these results, the precursor of the present invention does not meet with deterioration of image quality in plate making of PPC even under high temperature and high humidity conditions.

EXAMPLE 2

Using a fine quality paper coated with, on one side thereof, a bock layer and on the other side thereof, an intermediate layer, onto the intermediate layer was coated a dispersion obtained by ball milling for 2 hours a mixture of 34 g of a resin (S-2) having the following structure, 6 g (as solid) of the resin grains (L-3), 50 g of zinc oxide and 150 g of toluene and further ball milling for 10 minutes after adding thereto 4 g of 1,3-xylyene diisocyanate to give a dry coverage of 18 g/m$^2$ by means of a wire bar coater, followed by drying at 110° C. for 1.5 hours to prepare a lithographic printing plate precursor.

Resin (S-2)

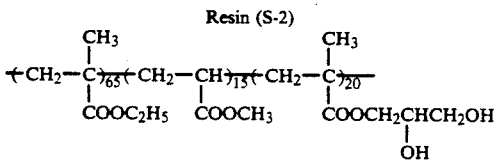

$\overline{M}w$: 3.5 × 10$^4$
(weight ratio)

This precursor was processed and subjected to plate making and printing in the same manner as in Example 1.

The resulting master plate had an image area with a density of at least 1.0 and clear image quality and a non-image area free from background stains, and was subjected to printing on fine quality papers using an offset printing machine (Oliver 52 type -commercial name-, manufactured by Sakurai Seisakusho KK). More than 3000 prints could be obtained without any problem on the background stains of non-image areas and the image quality of image areas.

Furthermore, when the above described precursor was subjected to plate making by a commercially available plain paper copy machine (PPC) under ambient conditions of 30° C. and 80% RH, the resulting master plate had an image area with a density of at least 1.0 and clear image quality and a non-image area free from background stains. When it was subjected to printing in the same manner as described above, there arose no problem even after printing 3000 prints or more.

As apparent from these results, the precursor of the present invention does not meet with deterioration of image quality in plate making of PPC even under high temperature and high humidity conditions.

EXAMPLES 3 TO 10

A mixture of 34 g of a resin (S-3) having the following structure, 6 g of resin grains (L) shown in Table 10, 70 g of zinc oxide, 10 g of silica gel, 5 g of 1,5-(N-imidazolyl)carbamoylnaphthalene and 150 g of toluene was dispersed in a ball mill for 2 hours. The resulting dispersion was coated onto a fine quality paper to give a dry coverage of 18 g/m$^2$ by means of a wire bar coater, followed by drying at 120° C. for 2 hours to prepare a lithographic printing plate precursor.

Resin (S-3)

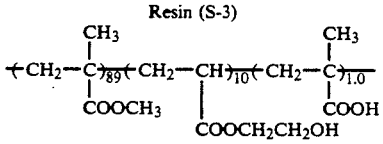

$\overline{M}w$: 5 × 10$^4$
(weight ratio)

TABLE 10

| Example | Resin Grains | Example | Resin Grains |
|---|---|---|---|
| 3 | (L-1) | 7 | (L-6) |
| 4 | (L-2) | 8 | (L-7) |
| 5 | (L-4) | 9 | (L-8) |
| 6 | (L-5) | 10 | (L-9) |

Each of the resulting precursors was processed and subjected to plate making and printing in an analogous manner to Example 1 except using an oil-desensitizing solution (E-2) prepared according to the following recipe:

| Oil-desensitizing Solution (E-2) | |
|---|---|
| Sodium Sulfite | 52 g |
| Newcol B4SN (commercial name, made by Nippon Nyukazai) | 10 g |
| Benzyl Alcohol | 80 g |
| Distilled Water to 1000 ml | |
| pH 11.0 adjusted with NaOH | |

The resulting master plate had an image area with a density of at least 1.0 and clear image quality and a non-image area free from background stains, and was subjected to printing on fine quality papers using an offset printing machine (Oliver 52 type -commercial name-, manufactured by Sakurai Seisakusho KK). More than 5000 prints could be obtained without any problem on the background stains of non-image areas and the image quality of image areas.

Furthermore, when the above described precursor was subjected to plate making by a commercially available plain paper copy machine (PPC) under ambient conditions of 30° C. and 80% RH, the resulting master plate had an image area with a density of at least 1.0 and clear image quality and a non-image area free from background stains. When it was subjected to printing in the same manner as described above, there arose no problem even after printing 3000 prints or more.

As apparent from these results, the precursor of the present invention does not meet with deterioration of image quality in plate making of PPC even under high temperature and high humidity conditions.

EXAMPLES 11 TO 14

A mixture of 34 g of a resin (S-4) having the following structure, 6 g (as solid) of resin grains (L) shown in Table 11, 5 g of silica gel, 5 g of alumina and 80 g of toluene was dispersed in a ball mill for 2 hours, to which 5 g of phthalic anhydride was further added, followed by dispersing for 10 minutes. the resulting dispersion was coated onto a fine quality paper to give a dry coverage of 18 g/m$^2$ by means of a wire bare coater, followed by drying at 120° C. for 20 hours to prepare a lithographic printing plate precursor.

Resin (S-4)

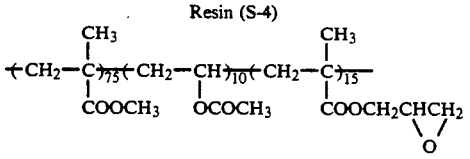

$\overline{M}w$: 5.5 × 10$^4$
(weight ratio)

TABLE 11

| Example | Resin Grains | Example | Resin Grains |
|---|---|---|---|
| 11 | (L-14) | 13 | (L-12) |
| 12 | (L-15) | 14 | (L-9) |

Each of the resulting precursors was processed and subjected to plate making and printing in an analogous manner to Example 3. The resulting printing precursor had a density of at least 1.0 and clear image quality. More than 3000 prints could be obtained with maintaining clear the image quality without background stains.

EXAMPLES 15 TO 26

0.5 mole of each of nucleophilic compounds shown in Table 12, 100 g of each of organic solvents shown in Table 12 and 10 g of Newcol B4SN were added to distilled water to 1000 ml, the pH being adjusted to 11.0 to prepare a processing solution. Each of the printing precursors prepared in Examples 2 to 14 was immersed in the thus resulting processing solution for 3 minutes and then subjected to printing under the similar printing conditions to those of Example 1.

TABLE 12

| Example | Light-sensitive Material | Nucleophilic Compound | Organic Solvents |
|---|---|---|---|
| 15 | Example 1 | sodium sulfite | benzyl alcohol |
| 16 | Example 2 | monoethanolamine | " |
| 17 | Example 3 | diethanolamine | methyl ethyl ketone |
| 18 | Example 4 | thiomalic acid | ethylene glycol |
| 19 | Example 5 | thiosalicylic acid | benzyl alcohol |
| 20 | Example 6 | taurine | isopropyl alcohol |
| 21 | Example 8 | 4-sulfobenzene-sulfinic acid | benzyl alcohol |
| 22 | Example 9 | thioglycolic acid | ethanol |
| 23 | Example 10 | 2-mercaptoethyl-phosphonic acid | dioxane |
| 24 | Example 11 | serine | — |
| 25 | Example 13 | sodium thio-sulfate | methyl ethyl ketone |
| 26 | Example 14 | sodium sulfite | benzyl alcohol |

Each of the resulting precursors was sufficiently rendered hydrophilic as represented by a contact angle of non-image areas with water of at most 10 degrees. When printing 3000 prints, the print maintained clear image quality without background stains.

EXAMPLE 27

Using a fine quality paper coated with, on one side thereof, a back layer and on the other side thereof, an intermediate layer, onto the intermediate layer was coated a dispersion obtained by ball milling for 2 hours a mixture of 25 g of the resin S-1), 10 g (as solid) of the resin grains (L-21), 50 g of zinc oxide and 150 g of toluene and further ball milling for 10 minutes after adding thereto 4 g of glutaric anhydride to give a dry coverage of 18 g/m$^2$ by means of a wire bar coater, followed by drying at 100° C. for 30 seconds and further heating at 120° C. for 1 hour and 30 minutes to prepare a lithographic printing plate precursor.

The resulting precursor was immersed for 3 minutes in the oil-desensitizing solution (E-1) prepared in Example 1.

On the thus oil-desensitized surface was placed 2 μl of a drop of distilled water and the contact angle between the surface and water was measured by a goniometer to obtain a contact angle with water of at most 10°. Before the oil-desensitizing processing, it was 98°. This tells that a non-image area on the image receptive layer in the precursor of the present invention was changed from lipophilic to hydrophilic. Ordinarily, it is required that such a degree of rendering hydrophilic that a non-image area does not produce background stains or spot-like stains during printing corresponds to a contact angle with water of 20° or less.

The precursor was subjected to plate making by means of a commercially available PPC and then to an oil-desensitizing processing under similar conditions to those described above to obtain a printing master plate.

The resulting master plate had an image area with a density of at least 1.0 and clear image quality and a non-image area free from background stains, and was subjected to printing on fine quality papers using an offset printing machine (Oliver 52 type -commercial name-, manufactured by Sakurai Seisakusho KK). More than 3000 prints could be obtained without any problem on the background stains of non-image areas and the image quality of image areas.

Furthermore, when the above described precursor was subjected to plate making by a commercially available plain paper copy machine (PPC) under ambient conditions of 30° C. and 80% RH, the resulting master plate had an image area with a density of at least 1.0 and clear image quality and a non-image area free from background stains. When it was subjected to printing in the same manner as described above, there arose no problem even after printing 3000 prints or more.

As apparent from these results, the precursor of the present invention does not meet with deterioration of image quality in plate making of PPC even under high temperature and high humidity conditions.

EXAMPLE 28

Using a fine quality paper coated with, on one side thereof, a back layer and on the other side thereof, an intermediate layer onto the intermediate layer was coated a dispersion obtained by ball milling for 2 hours a mixture of 34 g of the resin (S-2), 6 g (as solid) of the resin grains (L-23), 50 g of zinc oxide and 150 g of toluene and further ball milling for 10 minutes after adding thereto 4 g of 1,3 xylyene diisocyanate to give a dry coverage of 18 g/m$^2$ by means of a wire bar coater, followed by drying at 110° C. for 1.5 hours to prepare a lithographic printing plate precursor.

This precursor was processed and subjected to plate making and printing in the same manner as in Example 1.

This resulting master plate and an image area with a density of at least 1.0 and clear image quality and a non-image area free from background stains, and was subjected to printing on fine quality papers using an offset printing machine (Oliver 52 type -commercial name-, manufactured by Sakurai Seisakusho KK). More than 3000 prints could be obtained without any problem on the background stains of non-image areas and the image quality of image areas.

Furthermore, when the above described precursor was subjected to plate making by a commercially available plain paper copy machine (PPC) under ambient conditions of 30° C. and 80% RH, the resulting master plate had an image area with a density of at least 1.0 and clear image quality and a non-image area free from background stains. When it was subjected to printing in the same manner as described above, there arose no problem even after printing 3000 prints or more.

As apparent from these results, the precursor of the present invention does not meet with deterioration of image quality in plate making of PPC even under high temperature and high humidity conditions.

EXAMPLES 29 TO 36

A mixture of 34 g of the resin (S-3), 6 g of resin grains (L) shown in Table 13, 70 g of zinc oxide, 10 of silica gel, 5 g of 1,5-(N-imidazolyl)carbamoylnaphthalene and 150 g of toluene was dispersed in a ball mill for 2 hours. The resulting dispersion was coated onto a fine quality paper to give a dry coverage of 18 g/m$^2$ by means of a wire bar coater, followed by drying at 120° C. for 2 hours to prepare a lithographic printing plate precursor.

TABLE 13

| Example | Resin Grains | Example | Resin Grains |
|---|---|---|---|
| 29 | (L-21) | 33 | (L-28) |
| 30 | (L-22) | 34 | (L-30) |
| 31 | (L-23) | 35 | (L-31) |

TABLE 13-continued

| Example | Resin Grains | Example | Resin Grains |
|---|---|---|---|
| 32 | (L-24) | 36 | (L-36) |

Each of the resulting precursors processed and subjected to plate making and printing in an analogous manner to Example 3.

The resulting master plate had an image area with a density of at least 1.0 and clear image quality and a non-image area free from background stains, and was subjected to printing on fine quality papers using an offset printing machine (Oliver 52 type -commercial name-, manufactured by Sakurai Seisakusho KK). More than 3000 prints could be obtained without any problem on the background stains of non-image areas and the image quality of image areas, Furthermore, when the above described precursor was subjected to plate making by a commercially available plain paper copy machine (PPC) under ambient conditions of 30° C. and 80% RH, the resulting master plate had an image area with a density of at least 1.0 and clear image quality and a non-image area free from background stains. When it was subjected to printing in the same manner as described above, there arose no problem even after printing 3000 prints or more.

As apparent from these results, the precursor of the present invention does not meet with deterioration of image quality in plate making of PPC even under high temperature and high humidity conditions.

EXAMPLES 37 TO 40

A mixture of 34 g of the resin (S-4), 6 g (as solid) of resin grains (L) shown in Table 14, 5 g of silica gel, 5 g of alumina and 80 g of toluene was dispersed in a ball mill for 2 hours, to which 5 g of phthalic anhydride was further added, followed by dispersing for 10 minutes. The resulting dispersion was coated onto a fine quality paper to give a dry coverage 20 of 18 g/m$^2$ by means of a wire bar coater, followed by drying at 120° C. for 20 hours to prepare a lithographic printing plate precursor.

TABLE 14

| Example | Resin Grains | Example | Resin Grains |
|---|---|---|---|
| 37 | (L-27) | 39 | (L-32) |
| 38 | (L-32) | 40 | (L-26) |

Each of the resulting precursors was processed and subjected to plate making and printing in an analogous manner to Example 3. The resulting printing precursor had a density of at least 1.0 and clear image quality. More than 3000 prints could be obtained with maintaining clear the image quality without background stains.

EXAMPLES 41 TO 52

0.5 mole of each of nucleophilic compounds shown in Table 15, 100 g of each of organic solvents shown in Table 15 and 10 g of Newcol B4SN were added to distilled water to 1000 ml, the pH being adjusted to 11.0 to prepare a processing solution. Each of the printing precursors prepared in Examples 28 to 40 was immersed in the thus resulting processing solution for 3 minutes and then subjected to printing under the similar printing conditions to those of Example 1.

TABLE 15

| Example | Light-sensitive Material | Nucleophilic Compound | Organic Solvents |
|---|---|---|---|
| 41 | Example 27 | sodium sulfite | benzyl alcohol |
| 42 | Example 28 | monoethanolamine | " |
| 43 | Example 29 | diethanolamine | methyl ethyl ketone |
| 44 | Example 30 | thiomalic acid | ethylene glycol |
| 45 | Example 31 | thiosalicylic acid | benzyl alcohol |
| 46 | Example 32 | taurine | isopropyl alcohol |
| 47 | Example 34 | 4-sulfobenzene-sulfinic acid | benzyl alcohol |
| 48 | Example 35 | thioglycolic acid | ethanol |
| 49 | Example 36 | 2-mercaptoethyl-phosphonic acid | dioxane |
| 50 | Example 37 | serine | — |
| 51 | Example 39 | sodium thio-sulfate | methyl ethyl ketone |
| 52 | Example 40 | sodium sulfite | benzyl alcohol |

Each of the resulting precursors was sufficiently rendered hydrophilic as represented by a contact angle of non-image areas with water of at most 10degrees. When printing 3000 prints, the print maintained clear image quality without background stains.

EXAMPLE 53

A mixture of 4 g (as solid) of the resin grains (L-37), 30 g of a resin (B-1) consisting of a copolymer of methyl methacrylate/acrylic acid (99/1 by weight) having a weight average molecular weight of 45000, 100 g of zinc oxide and 300 g of toluene was dispersed in a homogenizer (made by Nippon Seiki KK) at $6\times10^3$ rpm for 10 minutes. Using a fine quality paper coated with, on one side thereof, a back layer and on the other side thereof, an intermediate layer, the thus resulting dispersion was coated onto the intermediate layer to give a dry coverage of 18 g/m$^2$ by means of a wire bar coater, followed by drying at 100° C. for 1 minute, thus obtaining a lithographic printing plate precursor.

The precursor was subjected to plate printing by means of a commercially available PPC, passed once though an etching using an oil-desensitizing solution ELP-EX (commercial name, manufactured by Fuji Photo Film Co., Ltd.) and then immersed in a processing solution (E-3) prepared by the following formulation for 3 minutes, following by washing with water.

| Processing Solution (E-3) | |
|---|---|
| 2-Mercaptoethylsulfonic Acid | 80 g |
| Neosoap (made by Takemoto Jushi KK) | 15 g |
| Benzyl Alcohol | 100 g |
| Distilled Water to 1000 ml | |
| pH 11.5 adjusted with KOH | |

The resulting master plate had an image area with a density of at least 1.0 and clear image quality and a non-image area free from background stains, and was subjected to printing on fine quality papers using an offset printing machine (Oliver 52 type -commercial name-, manufactured by Sakurai Seisakusho KK). More than 3000 prints could be obtained without any problem on the background stains of non-image areas and the image quality of image areas.

EXAMPLES 54 TO 61

The procedure of Example 53 was repeated except using each of resin grains shown in Table 16 instead of the resin grains (L-37) of the present invention to prepare a lithographic printing plate precursor.

TABLE 16

| Example | Resin Grains | Example | Resin Grains |
|---|---|---|---|
| 54 | (L-38) | 58 | (L-44) |
| 55 | (L-39) | 59 | (L-45) |
| 56 | (L-40) | 60 | (L-48) |
| 57 | (L-41) | 61 | (L-54) |

Each of the resulting precursors was processed and subjected to plate making in an analogous manner to Example 53, thus obtaining an offset master printing plate.

The resulting master plate had a density of at least 1.2 and clear image quality. When it was subjected to etching processing and printing by a printing machine, more than 3000 prints could be obtained without any problem on the background stains of non-image areas and the image quality of image areas.

EXAMPLE 62

A mixture of 4 g (as solid) of the resin grains (L-48), 29 g of a binder resin (B-2 having the following structure, 50 g of zinc oxide and 200 g of toluene was dispersed in a homogenizer at $6\times10^3$ rpm for minutes, to which 0.5 g of phthalic anhydride was further added, followed by dispersing for 1 minute at $1\times10^3$ rpm. The thus resulting dispersion was coated onto a support under the similar conditions to those of Example 53, dried at 100° C. for 30 seconds and further heated at 110° C. for 1 hour to prepare a lithographic printing plate precursor.

Binder Resin (B-2)

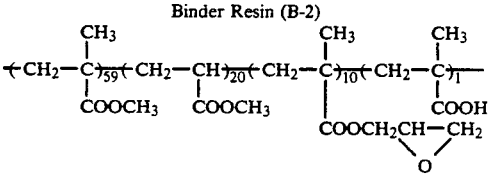

$\overline{M}w$: $5\times10^4$
(weight ratio)

The precursor was subjected to plate making in the same apparatus as used in Example 53, etching processing and printing in a printing machine. After plate making, the offset master plate had a density of at least 1.0 and clear image quality. After printing 4000 prints, the print maintained clear image quality without background stains.

EXAMPLE 63

A mixture of 4 g (as solid) of the resin grains (L-44), 30 g of a resin (B-3) having the following structure, 80 g of zinc oxide and 50 g of toluene was dispersed in a ball mill for 1.5 hours, to which 4 g of hexamethylene diisocyanate was further added, followed by dispersing in the ball mill for 10 minutes. Using a fine quality paper coated with, on one side thereof, a back layer and on the other side thereof, an intermediate layer, the thus resulting dispersion was coated onto he intermediate layer to give a dry coverage of 2.5 g/m$^2$ by means of a wire bar coater, followed by drying at 100° C. for 90 minutes, thus obtaining a lithographic printing plate precursor.

Binder Resin (B-3)

-continued

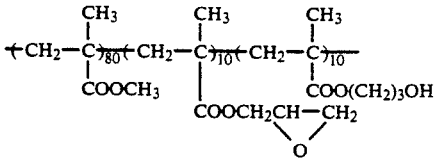

$\overline{M}w$: $5.3 \times 10^4$
(weight ratio)

The precursor was passed once though an etching processor using an oil-desensitizing solution ELP-EX (commercial name, manufactured by Fiji Photo Film Co., Ltd.) and then immersed in a processing solution (E-4) prepared by the following formulation for 3 minutes, followed by washing with water.

| Processing Solution (E-4) | |
|---|---|
| Thioglycolic Acid | 65 g |
| Newcol B4SN | 10 g |
| Methyl Ethyl Ketone | 80 g |
| Distilled Water to 1000 ml | |
| pH 10.5 adjusted with KOH | |

Each of the resulting precursors was sufficiently rendered hydrophilic as represented by a contact angle of non-image areas with water of at most 10 degrees. When it was subjected to plate making, to the above described oil-desensitizing and to printing in an analogous manner to Example 53, more than 3000 prints could be obtained without any problem on the background stains of non-image areas and the image quality of image areas.

EXAMPLES 64 TO 68

The procedure of Example 63 was repeated except using compounds shown in Table 17 instead of the hexamethylene diisocyanate used in Example 63:

TABLE 17

| Example | Compound (Crosslinking Agent) |
|---|---|
| 64 | ethylene glycol glycidyl ether |
| 65 | Eponit 12 (commercial name, made by Nitto Kasei KK) |
| 66 | Rikaresin PO-24 (commercial name, Shin-Nippon Rika KK) |
| 67 | diphenylmethane diisocyanate |
| 68 | triphenylmethane diisocyanate |

Each of the resulting precursors was subjected to plate making by the similar apparatus to that of Example 53, then to etching processing and printing by a printing machine. The resulting master plate for offset printing had a density of at least 1.0 and clear image quality. After printing 3000 prints, the print maintained clear image quality without background stains.

EXAMPLES 69 TO 78

The procedure of Example 62 was repeated except using 4 g (as solid) of resin grains (L) shown in Table 18 instead of 4 g of the resin grains (L-48), thus obtaining lithographic printing plate precursors.

TABLE 18

| Example | Resin Grains | Example | Resin Grains |
|---|---|---|---|
| 69 | (L-38) | 74 | (L-49) |
| 70 | (L-38) | 75 | (L-50) |
| 71 | (L-38) | 76 | (L-51) |
| 72 | (L-38) | 77 | (L-53) |

TABLE 18-continued

| Example | Resin Grains | Example | Resin Grains |
|---|---|---|---|
| 73 | (L-38) | 78 | (L-54) |

Each of the resulting precursors was processed and subjected to plate making and printing in an analogous manner to Example 3. More than 3000 prints could be obtained without any problem on the background stains of non-image areas and the image quality of image areas.

EXAMPLES 79 TO 90

Using each of the light-sensitive materials prepared in Examples 53 to 78, an etching processing was carried out as shown in the following to prepare a master plate for offset printing.

0.5 mole of each of nucleophilic compounds shown in Table 19, 100 g of each of organic solvents shown in Table 19 and 10 g of Newcol B4SN were added to distilled water to 1000 ml, the pH being adjusted to 11.0 to prepare a processing solution. Each of the printing precursors was immersed in the above described processing solution at 30° C. for 2 minutes and then subjected to printing under the similar printing conditions to those of Example 53.

TABLE 19

| Example | Light-sensitive Material | Nucleophilic Compound | Organic Solvents |
|---|---|---|---|
| 79 | Example 53 | sodium sulfite | benzyl alcohol |
| 80 | Example 54 | N,N-di(2-carboxy-ethyl)amine | " |
| 81 | Example 55 | N,N-di(2-hydroxy-ethyl)amine | methyl ethyl ketone |
| 82 | Example 56 | thiomalic acid | ethylene glycol |
| 83 | Example 57 | thiosalicylic acid | benzyl alcohol |
| 84 | Example 58 | taurine | isopropyl alcohol |
| 85 | Example 60 | 4-sulfobenzene-sulfinic acid | benzyl alcohol |
| 86 | Example 63 | thioglycolic acid | ethanol |
| 87 | Example 64 | 2-mercaptoethyl-phosphonic acid | dioxane |
| 88 | Example 67 | serine | — |
| 89 | Example 71 | sodium thio-sulfate | methyl ethyl ketone |
| 90 | Example 74 | 1,4-benzenedi-sulfinic acid | benzyl alcohol |

Each of the resulting precursors was sufficiently rendered hydrophilic as represented by a contact angle of non-image areas with water of at most 10 degrees. When printing 3000 prints in an analogous manner to Example 53, the print maintained clear image quality without background stains.

EXAMPLE 91

A mixture of 5 g (as solid) of the resin grains (L-55), 30 g of a resin (B-1) consisting of a copolymer of methyl methacrylate/acrylic acid (99/1 by weight) having a weight average molecular weight of 45000, 100 g of zinc oxide and 300 g of toluene was dispersed in a homogenizer (made by Nippon Seiki KK) at $6 \times 10^3$ rpm for 10 minutes Using a fine quality paper coated with, on one side thereof, a back layer and on the other side thereof, an intermediate layer, the thus resulting dispersion was coated onto the intermediate layer to give a dry coverage of 18 g/m$^2$ by means of a wire bar coater, following by drying at 100° C. for 1 minute, thus obtaining a lithographic printing plate precursor.

The precursor was subjected to plate printing by means of a commercially available PPC, passed once though an etching using an oil-desensitizing solution ELP-EX (commercial name, manufactured by Fuji Photo Film Co., Ltd.) and then immersed in a processing solution (E-5) prepared by the following formulation for 3 minutes, following by washing with water.

| Processing Solution (E-5) | |
|---|---|
| Thiomalic Acid | 52 g |
| Newcol B4NS | 10 g |
| Methyl Ethyl Ketone | 100 g |
| Distilled Water to 1000 ml | |
| pH 10.0 adjusted with NaOH | |

On the thus oil-desensitized surface was placed 2 μl of a drop of distilled water and the contact angle between the surface and water was measured by a goniometer to obtain a contact angle with water of at most 10°. Before the oil-desensitizing processing, it was 98°. This tells that the image receptive layer in the precursor of the present invention wa sufficiently rendered hydrophilic.

The resulting master plate had an image area with a density of at least 1.0 and clear image quality and a non-image area free from background stains, and was subjected to printing on fine quality papers using an offset printing machine (Oliver 52 type -commercial name-, manufactured by Sakurai Seisakusho KK). More than 3000 prints could be obtained without any problem on the background stains of non-image areas and the image quality of image areas.

EXAMPLES 92 TO 99

The procedure of Example 91 was repeated except using each of resin grains shown in Table 20 instead of the resin grains (L-55) of the present invention to prepare a lithographic printing plate precursor.

TABLE 20

| Example | Resin Grains | Example | Resin Grains |
|---|---|---|---|
| 92 | (L-56) | 96 | (L-62) |
| 93 | (L-57) | 97 | (L-63) |
| 94 | (L-60) | 98 | (L-64) |
| 95 | (L-61) | 99 | (L-65) |

Each of the resulting precursors was processed and subjected to plate making in an analogous manner to Example 91, thus obtaining an offset master printing plate.

The resulting master plate had a density of at least 1.2 and clear image quality. When it was subjected to etching processing and printing by a printing machine, more than 3000 prints could be obtained without any problem on the background stains of non-image areas and the image quality of image areas.

EXAMPLE 100

A mixture of 4 g (as solid) of the resin grains (L-55), 29 g of the binder resin (B-2), 50 g of zinc oxide and 200 g of toluene was dispersed in a homogenizer at $6\times10^3$ rpm for 10 minutes, to which 0.5 g of phthalic anhydride was further added, followed by dispersing for 1 minute at $1\times10^3$ rpm. The thus resulting dispersion was coated onto a support under the similar conditions to those of Example 91, dried at 100° C. for 30 seconds and further heated at 110° C. for 1 hour to prepare a lithographic printing plate precursor.

The precursor was subjected to plate making in the same apparatus as used in Example 91, etching processing and printing in a printing machine. After plate making, the offset master plate had a density of at least 1.0 and clear image quality. After printing 4000 prints, the print maintained clear image quality without background stains.

EXAMPLE 101

A mixture of 4 g (as solid) of the resin grains (L-65), 30 g of the resin (B-3), 80 g of zinc oxide and 50 g of toluene was dispersed in a ball mill for 1.5 hours, to which 4 g of hexamethylene diisocyanate was further added, followed by dispersing in the ball mill. Using a fine quality paper coated with, on one side thereof, a back layer and on the other side thereof, an intermediate layer, the thus resulting dispersion was coated onto he intermediate layer to give a dry coverage of 2.5 g/m$^2$ by means of a wire bar coater, followed by drying at 100° C. for 90 minutes, thus obtaining a lithographic printing plate precursor.

The precursor was passed once though an etching processor using an oil-desensitizing solution ELP-EX and then immersed in a processing solution (E-6) prepared by the following formulation for 3 minutes, followed by washing with water.

| Processing Solution (E-6) | |
|---|---|
| Mercaptopropionic Acid | 75 g |
| Neosoap | 15 g |
| Benzyl Alcohol | 95 g |
| Distilled Water to 1000 ml | |
| pH 10.0 adjusted with NaOH | |

On the thus oil-desensitized surface was placed 2 μl of a drop of distilled water and the contact angle between the surface and water was measured by a goniometer to obtain a contact angle with water of at most 10°. Before the oil-desensitizing processing, it was 98°. This tells that a non-image area on the image receptive layer in the precursor of the present invention wa changed form lipophilic to hydrophilic. Ordinarily, it is required that such a degree of rendering hydrophilic that a non-image are does not produce background stains or spot-like stains during printing corresponds a contact angle with water of 20° or less. When printing 3000 prints, the print maintained clear image quality without background stains.

Furthermore, the above-described precursor was subjected to the same processing as described above after it was allowed to stand for 3 weeks under the ambient conditions (45° C., 75% RH), there was no change from before the passage of time.

EXAMPLES 102 TO 106

The procedure of Example 101 was repeated except using compounds shown in Table 21 instead of the hexamethylene diisocyanate used in Example 101:

TABLE 21

| Example | Compound (Crosslinking Agent) |
|---|---|
| 102 | ethylene glycol glycidyl ether |
| 103 | Eponit 12 |
| 104 | Rikaresin PO-24 |
| 105 | diphenylmethane diisocyanate |

TABLE 21-continued

| Example | Compound (Crosslinking Agent) |
|---|---|
| 106 | triphenylmethane diisocyanate |

Each of the resulting precursors was subjected to plate making by the similar apparatus to that of Example 91, then to etching processing and printing by a printing machine. The resulting master plate for offset printing had a density of at least 1.0 and clear image quality. After printing 3000 prints, the print maintained clear image quality without background stains.

EXAMPLES 106 TO 115

The procedure of Example 101 was repeated except using 4 g (as solid) of resin grains (L) shown in Table instead of 4 g of the resin grains (L-65), thus obtaining lithographic printing plate precursors.

TABLE 22

| Example | Resin Grains | Example | Resin Grains |
|---|---|---|---|
| 106 | (L-56) | 111 | (L-62) |
| 107 | (L-58) | 112 | (L-63) |
| 108 | (L-59) | 113 | (L-64) |
| 109 | (L-60) | 114 | (L-66) |
| 110 | (L-61) | 115 | (L-70) |

Each of the resulting precursors was processed and subjected to plate making and printing in an analogous manner to Example 101. More than 3000 prints could be obtained without any problem on the background stains of non-image areas and the image quality of image

EXAMPLES 116 TO 119

The procedure of Example 101 was repeated except using 4 g (as solid) of resin grains (L) shown in Table 23 instead of 4 g of the resin grains (L-65), thus obtaining lithographic printing plate precursors.

TABLE 23

| Example | Resin Grains | Example | Resin Grains |
|---|---|---|---|
| 116 | (L-67) | 118 | (L-69) |
| 117 | (L-68) | 119 | — |

Each of the thus resulting printing precursor was processed as described below.

Firstly, the precursor was immersed in a buffer solution with a pH of 3.0 for 3 minutes and then immersed in the oil-desensitizing solution (E-5) used in Example 91 for 1 minute. The precursor was sufficiently rendered hydrophilic as represented by a contact angle of the non-image area with water of at most 10°.

When the printing plate for offset printing was subjected to printing by a printing machine using a dampening water obtained by diluting the processing solution (E-6) by 50 times with distilled water, more than 3000 prints could be obtained without any problem on the background stains of non-image areas and the image quality of image areas.

EXAMPLES 120 TO 131

Using each of the light-sensitive materials prepared in Examples 91 to 119, an etching processing was carried out as shown in the following to prepare a master plate for offset printing.

0.5 mole of each of nucleophilic compounds shown in Table 24, 100 g of each of organic solvents shown in Table 24 and 10 g of Newcol B4SN were added to distilled water to 1000 ml, the pH being adjusted to 10.5 to prepare a processing solution. Each of the printing precursors was immersed in the above described processing solution at 30° C. for 2 minutes. The resulting printing plate was then subjected to printing under the similar printing conditions to those of Example 91.

TABLE 24

| Example | Light-sensitive Material | Nucleophilic Compound | Organic Solvents |
|---|---|---|---|
| 120 | Example 91 | sodium sulfite | benzyl alcohol |
| 121 | Example 92 | N,N-di(2-carboxy-ethyl)amine | " |
| 122 | Example 93 | N,N-di(2-hydroxy-ethyl)amine | methyl ethyl ketone |
| 123 | Example 94 | thiomalic acid | ethylene glycol |
| 124 | Example 95 | thiosalicylic acid | benzyl alcohol |
| 125 | Example 96 | taurine | isopropyl alcohol |
| 126 | Example 98 | 4-sulfobenzene-sulfinic acid | benzyl alcohol |
| 127 | Example 101 | thioglycolic acid | ethanol |
| 128 | Example 102 | 2-mercaptoethyl-phosphonic acid | dioxane |
| 129 | Example 105 | serine | — |
| 130 | Example 109 | sodium thio-sulfate | methyl ethyl ketone |
| 131 | Example 74 | 1,4-benzenedi-sulfinic acid | benzyl alcohol |

Each of the resulting precursors was sufficiently rendered hydrophilic as represented by a contact angle of non-image areas with water of at most 10 degrees. When printing 3000 prints in an analogous manner to Example 91, the print maintained clear image quality without background stains.

According to the present invention, there is provided a process for the production of a lithographic printing plate precursor of direct image type, which is capable of sufficiently preventing occurrence of background stains and having excellent printing durability.

What is claimed is:

1. A process for the production of a lithographic printing plate of direct image type, which comprises (a) forming an image on a lithographic printing plate precursor comprising a base and a light-insensitive image receptive layer provided on the base, wherein the image receptive layer comprises resin grains comprising at least one polymer component having (1) at least one of a functional group represented by at least one of Formula (I) and Formula (II): wherein $—W_1—$ and $—W_2—$ each respectively represents $—SO_2—$, —CO— or —OOC—; $n_1$ and $n_2$ each respectively represents 0 or 1; and X represents a halogen atom, or (2) having at least one of a formyl group and a functional group represented by Formula (III): wherein $R_1$ and $R_2$, which are the same or different, each represents hydrocarbon groups or $R_1$ and $R_2$ are organic residual radicals which are combined with each other to form a ring and then (b) subjecting a non-image area other than the image area to coil-desensitizing treatment with a solution containing a hydrophilic compound containing a substituent having a Pearson's nucleophilic constant, n, of at least 5.5.

2. The process as claimed in claim 1, wherein the polymer component has a crosslinked structure.

3. The process as claimed in claim 1, wherein the resin grains are non-aqueous solvent dispersed resin grains obtained by subjecting a monofunctional monomer (A) and a monofunctional monomer (M) to dispersion polymerization reaction in a non-aqueous solvent, the monofunctional monomer comprises at least one of the functional group represented by Formula (I) and the functional group represented by Formula (II) or at least one of the formyl group and the functional group represented by Formula (III) and the monofunctional monomer (A) is soluble in the non-aqueous solvent, but is insoluble after polymerization and the monofunctional polymer (M) comprises a principal polymer chain comprising recurring units which each comprises at least one of a silicon atom and a fluorine atom-containing substituent, wherein a polymerizable double bond group represented by Formula (IV) is bonded to only one end of the principal polymer chain:

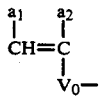

Formula (IV)

wherein $V_0$ represents —O—, —COO—, —OCO—, —$CH_2OCO$—, —$CH_2COO$—, —$SO_2$—,

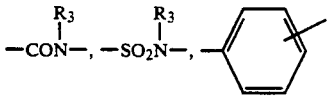

—CONHCOO— or —CONHCONH—; $R_3$ represents a hydrogen atom or a hydrocarbon group containing 1 to 18 carbon atom; $a_1$ and $a_2$, which are the same or different, each represents a hydrogen atom, halogen atom, cyano group, hydrocarbon group, —COO—$R_4$ or —COO—$R_4$ via a hydrocarbon group; and $R_4$ represents a hydrogen atom or an optionally substituted hydrocarbon group.

4. The process as claimed in claim 1, wherein the resin grains have a maximum grain diameter of at most 10 μm and an average grain diameter of at most 1 μm.

5. The process as claimed in claim 1, wherein the resin grains are present in a proportion of 10 to 90 parts per weight per 100 parts by weight of the image receptive layer-forming composition.

6. The process as claimed in claim 1, wherein the image receptive layer further contains a binder resin.

7. The process as claimed in claim 6, wherein the binder resin has a molecular weight of $10^3$ to $10^6$ and a glass transition point of −10° C. to 125° C.

8. The process as claimed in claim 1, wherein the image receptive layer further contains at least one inorganic pigment selected from the group consisting of kaolin, clay, calcium carbonate, silica, titanium oxide, zinc oxide, barium sulfate and alumina.

9. The process as claimed in claim 8, wherein the inorganic pigment is present in an amount which provides a ratio of binder resin to pigment in the range of 1 to 0.5–5 by weight.

10. The process as claimed in claim 1, wherein the image receptive layer further contains a crosslinking agent.

11. The process as claimed in claim 1, wherein the base is coated with an intermediate layer under the image receptive layer.

12. The process as claimed in claim 1, wherein the base is coated with a back layer on a side opposition to the image receptive layer.

13. The process as claimed in claim 3, wherein the monofunctional polymer (M) is present in a proportion of 1 to 50% by weight to the monomer (A).

14. The process as claimed in claim 3, wherein the recurring units are present in a proportion of at least 40% by weight based on the weight of the monomer (M).

15. The process as claimed in claim 3, wherein the resin grains have a hydrophilicity such that the film, formed by dissolving the resin grains in a solvent followed by coating, has a contact angle with distilled water of at most 50 degrees measured by an onigometer.

16. The process as claimed in claim 3, wherein a multifunctional monomer D coexist with the monofunctional polymer (M) and the monomer (A).

17. A lithographic printing plate precursor of direct image type, comprising a base and an image receptive layer provided on the base, wherein the image receptive layer comprises resin grains comprising at least one polymer component (1) having at least one of a functional group represented by at least one of Formula (I) and Formula (II):

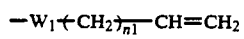

Formula (I)

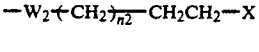

Formula (II)

wherein —$W_1$— and —$W_2$— each respectively represents —$SO_2$—, —CO— or —OOC—; $n_1$ and $n_2$ each respectively represents 0 or 1; and X represents a halogen atom, or (2) having at least one of a formyl group and a functional group represented by Formula (III):

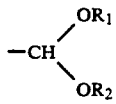

Formula (III)

wherein $R_1$ and $R_2$, which are the same or different, each represents hydrocarbon groups or $R_1$ and $R_2$ are organic residual radicals which are combined with each other to form a ring.

18. The lithographic printing plate precursor of direct image type as claimed in claim 17, wherein the polymer component has a crosslinked structure.

19. The lithographic printing plate precursor of direct image type as claimed in claim 17, wherein the resin grains are non-aqueous solvent dispersed resin grains obtained by subjecting a monofunctional (A) and a monofunctional monomer (M) to dispersion polymerization reaction in a non-aqueous solvent, the monofunctional monomer (A) comprises at least one of the functional group represented by Formula (I) and the functional group represented by Formula (II) or at least one of the formyl group and the functional group represented by Formula (III) and the monofunctional monomer (A) is soluble in the non-aqueous solvent, but is insoluble after polymerization and the monofunctional polymer (M) comprises a principal polymer chain comprising recurring units which each comprises at least one of a silicon atom and a fluorine atom-containing substitutent, wherein a polymerizable double bond group represented by Formula (IV) is bonded to only one end of the principal polymer chain:

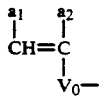

Formula (IV)

wherein $V_0$ represents —O—, —COO—, —OCO—, —$CH_2OCO$—, —$CH_2COO$—, —$SO_2$—,

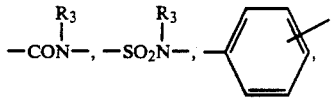

—CONHCOO— or —CONHCONH—; $R_3$ represents a hydrogen atom or a hydrocarbon group containing 1 to 18 carbon atom; $a_1$ and $a_2$, which are the same or different, each represents a hydrogen atom, halogen atom, cyano group, hydrocarbon group, —COO—$R_4$ or —COO—$R_4$ via a hydrocarbon group; and $R_4$ represents a hydrogen atom or optionally substituted hydrocarbon group.

20. The lithographic printing plate precursor of direct image type as claimed in claim 17, wherein the image receptive layer further contains a binder resin.

* * * * *